United States Patent [19]

Uya et al.

[11] 4,355,559

[45] Oct. 26, 1982

[54] ELECTRONIC MUSICAL INSTRUMENT

[75] Inventors: Masaru Uya, Kadoma; Kinji Kawamoto, Yahata, both of Japan

[73] Assignee: Matsushita Electric Industrial Co. Ltd., Osaka, Japan

[21] Appl. No.: 138,516

[22] Filed: Apr. 9, 1980

[30] Foreign Application Priority Data

Apr. 12, 1979 [JP] Japan ..... 54-44919

[51] Int. Cl.[3] ..... G10F 1/00

[52] U.S. Cl. ..... 84/1.03; 84/1.01

[58] Field of Search ..... 84/1.03, 1.01

[56] References Cited

U.S. PATENT DOCUMENTS

| | | | |
|---|---|---|---|
| 3,746,772 | 7/1973 | Ogi et al. | 84/1.02 |
| 3,878,750 | 4/1975 | Kapps | 84/1.01 |
| 3,889,568 | 6/1975 | Amaya | 84/1.01 |
| 4,022,097 | 5/1977 | Strangio | 84/1.03 |
| 4,129,055 | 12/1978 | Whittington et al. | 84/1.03 |
| 4,156,379 | 5/1979 | Studer | 84/1.03 |
| 4,184,401 | 1/1980 | Hiyoshi et al. | 84/1.03 |
| 4,235,142 | 11/1980 | Nakada et al. | 84/1.03 |
| 4,240,317 | 12/1980 | Kmetz | 84/1.03 |
| 4,283,983 | 8/1981 | Kashio | 84/1.19 |

FOREIGN PATENT DOCUMENTS 2529529 of 0000 Fed. Rep. of Germany .

OTHER PUBLICATIONS

DE-Prospekt Der Fa. Roland, Prospekt Zum MC8-Micro Composer, Aug. 1977.

DE-Katalog Der Fa. Roland, Perfekte Sound Systeme, S. 8, Beschreibung Zum Gert "CSQ-100 Digital-Sequenzer", (Vorstellung Des Gerats Auf Der Frankfurter Fruhjahrsmesse 1979).

*Primary Examiner*—David Smith, Jr.
*Assistant Examiner*—Forester W. Isen
*Attorney, Agent, or Firm*—Wenderoth, Lind & Ponack

[57] ABSTRACT

An electronic musical instrument equipped with multiple musical tone signal generating channels, with an automatic play system which controls the tone generation of the musical tone signal generating channels on the basis of the automatic play data recorded in a memory so as to successively and automatically generate musical tones. The instrument also has a manual play system which controls the tone generation of the musical tone signal generating channels by the keyboard and other performance controls so as to generate musical tones by control of the tone generation of the multiple musical tone signal generating channels by the joint use of the automatic play system and the manual play system.

4 Claims, 40 Drawing Figures

MEMORY CONSTRUCTION OF AUTOMATIC PLAY DATA MEMORY 2

EXAMPLE OF COMPOSITION OF NOTE DATA

TOP 3 BITS — PITCH DATA

BOTTOM 4 BITS

| | 001 | 010 | 011 | 100 | 101 | 110 |
|---|---|---|---|---|---|---|
| 0001 | $C_1$ | $C_2$ | $C_3$ | $C_4$ | $C_5$ | $C_6$ |
| 0010 | $C_1^{\#}$ | $C_2^{\#}$ | $C_3^{\#}$ | $C_4^{\#}$ | $C_5^{\#}$ | |
| 0011 | $D_1$ | $D_2$ | $D_3$ | $D_4$ | $D_5$ | |
| 0100 | $D_1^{\#}$ | $D_2^{\#}$ | $D_3^{\#}$ | $D_4^{\#}$ | $D_5^{\#}$ | |
| 0101 | $E_1$ | $E_2$ | $E_3$ | $E_4$ | $E_5$ | |
| 0110 | $F_1$ | $F_2$ | $F_3$ | $F_4$ | $F_5$ | |
| 0111 | $F_1^{\#}$ | $F_2^{\#}$ | $F_3^{\#}$ | $F_4^{\#}$ | $F_5^{\#}$ | |
| 1000 | $G_1$ | $G_2$ | $G_3$ | $G_4$ | $G_5$ | |
| 1001 | $G_1^{\#}$ | $G_2^{\#}$ | $G_3^{\#}$ | $G_4^{\#}$ | $G_5^{\#}$ | |
| 1010 | $A_1$ | $A_2$ | $A_3$ | $A_4$ | $A_5$ | |
| 1011 | $A_1^{\#}$ | $A_2^{\#}$ | $A_3^{\#}$ | $A_4^{\#}$ | $A_5^{\#}$ | |
| 1100 | $B_1$ | $B_2$ | $B_3$ | $B_4$ | $B_5$ | |

FIG. 8

NOTE LENGTH CODE

| NOTE LENGTH | NOTE LENGTH CODE |
|---|---|
| 𝅝 / 𝅗𝅥 | 1 0 0 1 |
| 𝅗𝅥. / 𝅗𝅥. | 1 0 0 0 |
| 𝅗𝅥 / 𝅗𝅥 | 0 1 1 1 |
| 𝄽. / ♩. | 0 1 1 0 |
| 𝄽 / ♩ | 0 1 0 1 |
| 𝄾. / ♪. | 0 1 0 0 |
| 𝄾 / ♪ | 0 0 1 1 |
| 𝄿. / 𝅘𝅥𝅯. | 0 0 1 0 |
| 𝄿 / 𝅘𝅥𝅯 | 0 0 0 1 |

MSB LSB

FIG. 9

TONE COLOR NUMBER

| TONE COLOR | TONE COLOR NUMBER |
|---|---|
| FLUTE | 0 0 0 1 |
| PIANO | 0 0 1 0 |
| VIOLIN | 0 0 1 1 |
| TRUMPET | 0 1 0 0 |
| OBOE | 0 1 0 1 |
| CLARINET | 0 1 1 0 |
| HARPSICORD | 0 1 1 1 |
| SAXOPHONE | 1 0 0 0 |
| TROMBONE | 1 0 0 1 |
| TUBA | 1 0 1 0 |

MSB LSB

FIG. 10

TONE GENERATION GATING AREA (GTA) (1076H)

(1079H)

EFFECTIVE KEY NUMBER AREA (AKNA)

FIFO AREA (FIFO)

MOVED TO LEFT BY FIFO INLET PROCESSING

FIG. 22a
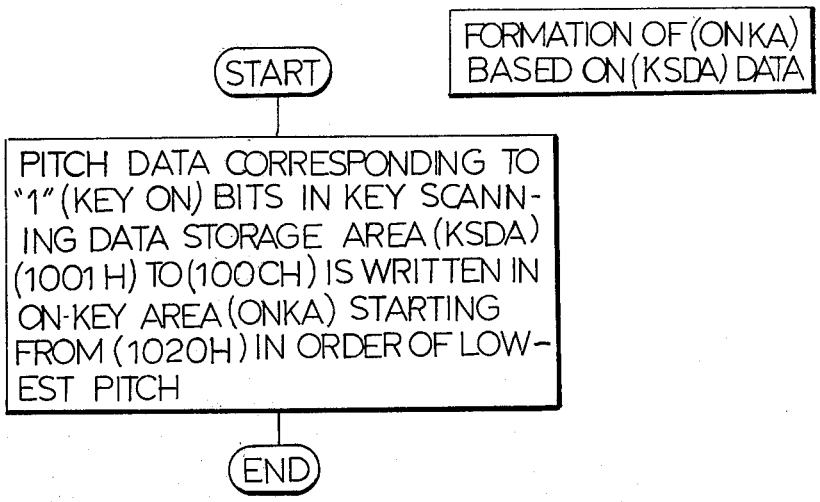
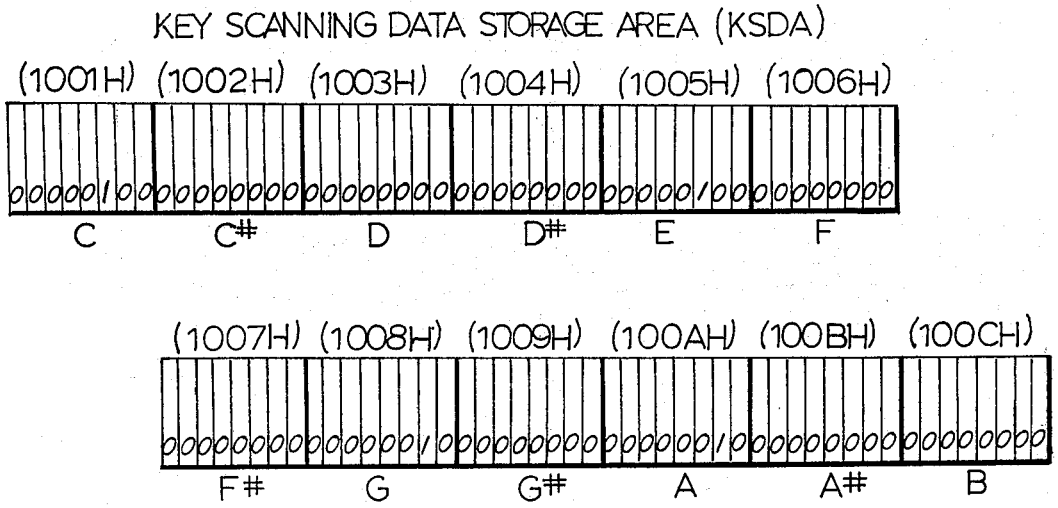
FIG. 22b
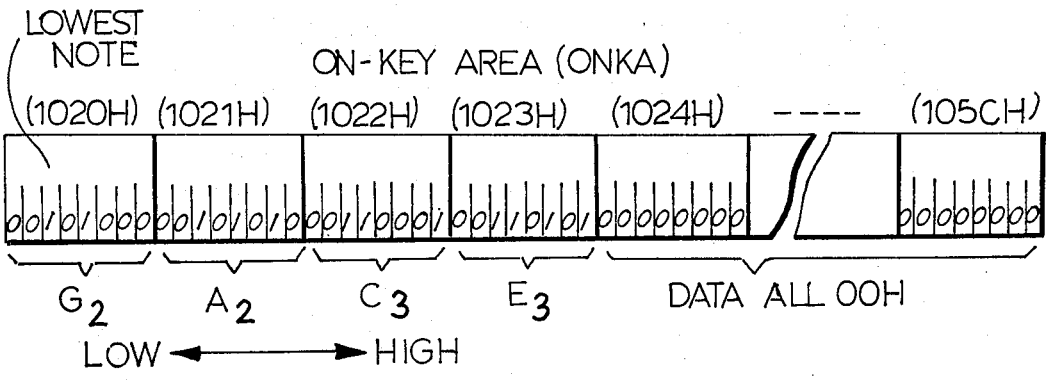
FIG. 22c

ELECTRONIC MUSICAL INSTRUMENT

BACKGROUND OF THE INVENTION

This invention relates to electronic musical instruments, especially electronic musical instruments provided with a limited number of tone generation channels and allowing both automatic play using part or all of the tone generation channels and allowing also manual play using the remaining tone generation channels not used for automatic play, and further relates to electronic musical instruments allowing the changeover of any or all of the tone generation channels used for automatic play for use for manual play and allowing conversely the return of any or all of the changed over tone generation channels back to automatic play.

It takes considerable practice to play electronic musical instruments, in particular electronic organs, polyphonic music synthesizers, and other polyphonic musical instruments. In order to master the performance of music requiring the full use of both hands and feet, correspondingly longer practice periods and harder effort are necessary. The usual way to practice musical performances requiring the use of both hands and feet is to raise the level of practice step by step, for example by first practicing with the right hand (upper keyboard), then practice by adding the left hand (lower keyboard), and finally practice by adding the feet (pedal keyboard). However, when one practices independently with only the right hand, left hand, or feet, one is playing only one part of the music. This means that one is practicing without a grasp of the music as a whole, and effect of the practice is extremely poor.

SUMMARY OF THE INVENTION

With this invention, one can set the music one wishes to play on to automatic play, stop the tone generation of the automatic play of only the part one desires to practice, for example, the part of the melody played on the upper keyboard, and practice while playing together with the automatic play by taking care of the stopped part ones self (minus one performance). After that has been mastered, one can stop the tone generation of the next part one wishes to practice, for example part of the automatic play of the accompaniment part played on the lower keyboard, and practice while playing together with the automatic play by taking care of the two stopped parts ones self (minus two performance). After this has been mastered in turn, one proceeds to the next step. Thus an extremely efficient method of practicing is made possible. Furthermore, since it is possible to play together with the automatic play even when the purpose is not practice, one can so to speak play as if one were a member of an orchestra (minus N performance) or can perform pieces requiring advanced techniques, such as by setting music which would be impossible by manual play on to automatic play and playing together with that. By rationally using this limited number of tone generation channels, an extremely high valued effect can be achieved with this electronic musical instrument.

BRIEF DESCRIPTION OF THE DRAWINGS

Below, an explanation is given of examples of applications of this invention in reference to the drawing figures, wherein:

FIG. 8 is a diagram showing an actual example of pitch data;

FIG. 9 is a diagram showing an actual example of note length code;

FIG. 10 is a diagram showing an actual example of tone color numbers;

FIG. 22*a* is a diagram showing a detailed flow chart of "formation of ONKA based on data of KSDA";

FIG. 22*b* and FIG. 22*c* are diagrams showing examples of the same;

DESCRIPTION OF PREFERRED EMBODIMENTS

In this text, "manual play" is not limited to performance by the hands, but means performance using hands, legs, and any other part of the human body.

Figure 1A:
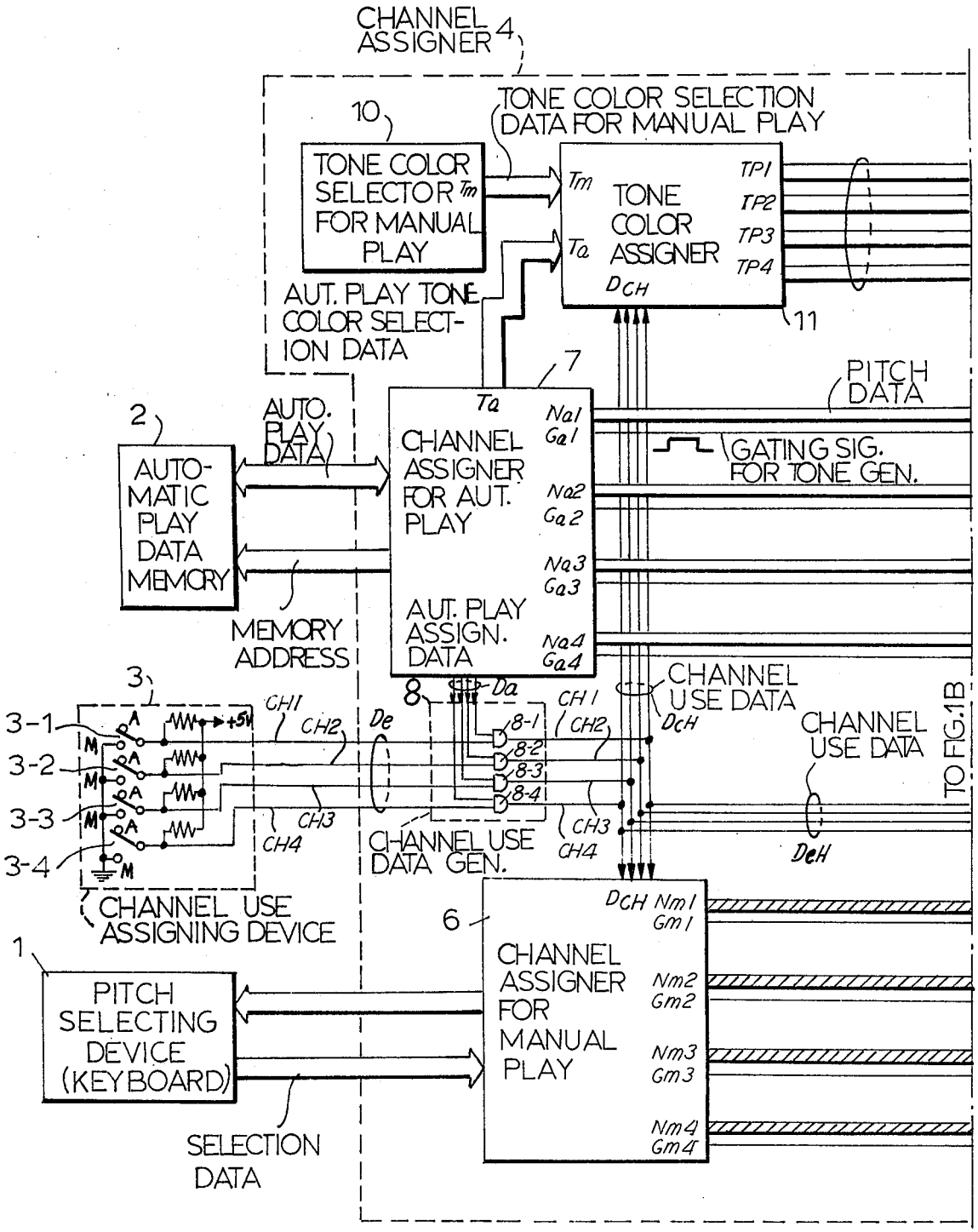
FIGS. 1*a* and 1*b* illustrate a circuit diagram of one application example of this invention.
Figure 1B:
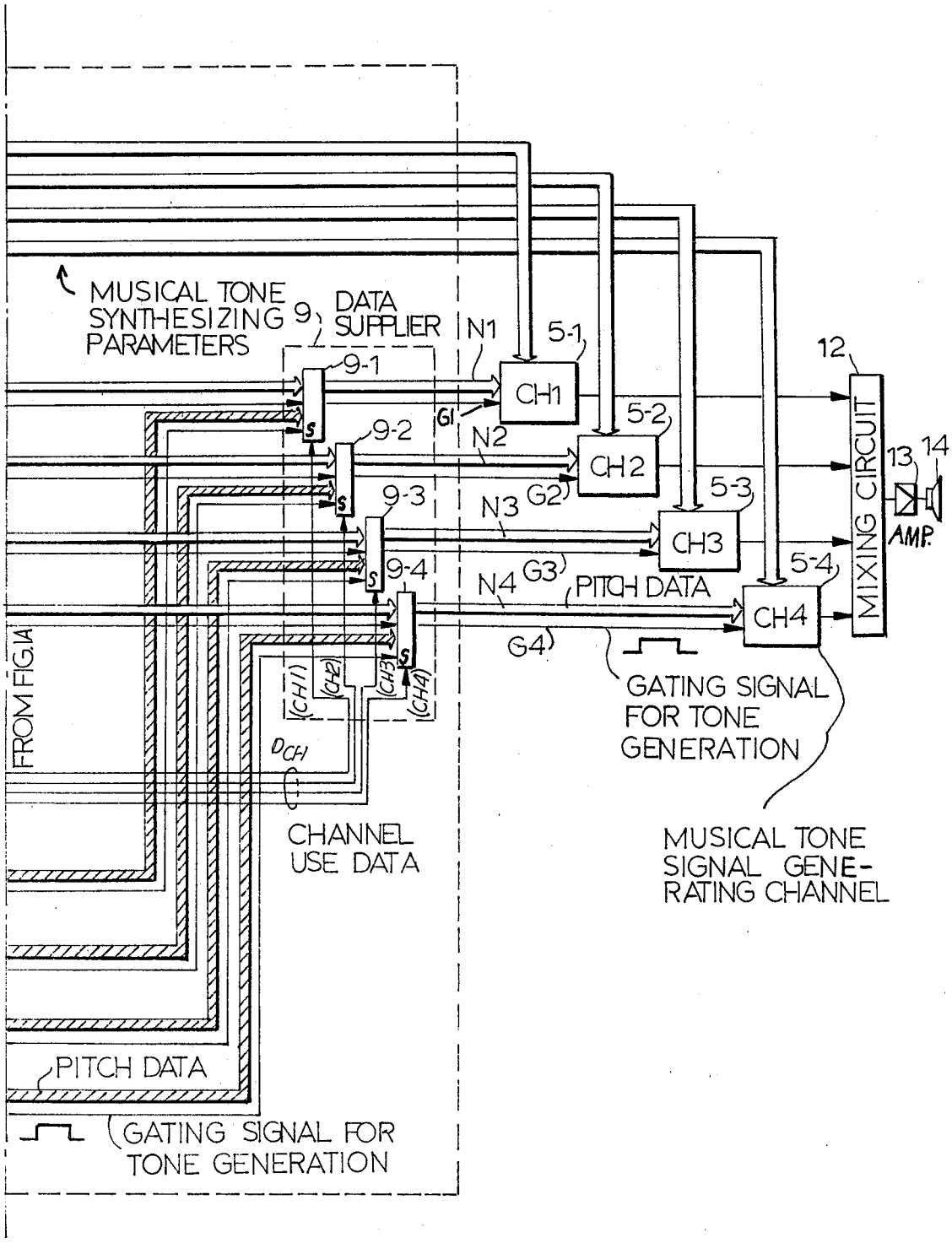

FIGS. 1*a* and 1*b* shows the circuit structure of one example of an application of this invention.

Element 1 is the pitch selecting device for setting the pitch according to the manual play operation, and is composed of the keyboards (including upper and lower keyboards, and pedal keyboard) used for manual play and the like. Element 2 is the automatic play data memory in which is stored the automtic play data including information on the pitch and length of the note of the tone scale used in the automatically performed music, and is composed of a RAM (Random Access Memory) or of a ROM (Read Only Memory) in which the data is recorded in the form of digital signals. Channels 5-1 to 5-4 are musical tone signal generating channels which generate musical tone signals, of the pitch based on the pitch data, synchronized with the gating signal for tone generation, from the pitch data N1 to N4 and the gating signals for tone generation G1 to G4 applied to those channels. In this application example, four musical tone signal generating channels are discussed for the purpose of simplifying the explanation, but the actual number thereof is not limited and the number used can be as many as desired. Furthermore, due to the length of its name, "musical tone signal generating channel" is hereinafter in this explanation referred to as "channel" or "CH".

Element 3 is the channel-use assigning device, and enables any or all of the channels of channels 5-1 to 5-4 assigned for automatic play use to be changed over and used for manual play and enables conversely those channels to be returned to their original state.

Element 4 is the channel assigner, and, based on the selection data of the pitch selecting device 1, the recorded data of the automatic play data memory 2, and the assignment data of the channel-use assigning device 3, creates the gating signal for tone generation and the pitch data for automatic play according to the automatic play data of automatic play data memory 2 and supplies them to the channels of channels 5-1 to 5-4 assigned for automatic play and supplies the gating signal for tone generation and the pitch data determined by the selection data of the pitch selecting device 1 to the channels assigned for manual play. Element 12 is the mixing circuit which mixes the the musical tone signals outputted from musical tone signal generating channels 5-1 to 5-4. Elements 13 and 14 are the amplifier and speaker which amplify and convert into audio musical tones the output musical tone signals of the mixing circuit 12.

Next, a simple explanation is given of the operation of the application example of FIGS. 1*a* and 1*b*. Here, channels 5-1 to 5-4 are abbreviated as CH1 to CH4.

Now, an explanation is given of the case when the series of automatic play data stored in the automatic play data memory 2 is the data for the three channels CH1 to CH3. Channel-use assigning device 3 is considered to be in the initial state, that is, the state where no channel has been given the indication to change over from automatic play to manual play.

When the signal is given to start automatic play, the channel assigner 4 reads successively the automatic play data of automatic play data memory 2, stored in accordance with the address series, and while doing this creates the pitch data N1 to N3 and the gating signals for tone generation G1 to G3, corresponding to CH1 to CH3, based on the pitch and length information of the notes of the tone scale. The assigner then supplies the created pitch data and gating signals for tone generation, synchronized with the automatic play tempo, to the corresponding channels CH1 to CH3. CH1 to CH3 each output musical tone signals of the pitch corresponding to the supplied pitch data in synchronization with the gating signals for tone generation. The musical tone signals outputted from CH1 to CH3 are mixed by the mixing circuit 12, connected afterwards, and pass through amplifier 13 and speaker 14 to become automatic play tones.

If during this time the pitch selecting device 1, that is, the keyboards, is operated manually for an ensemble with the automatic play, then the channel assigner 4 both performs the automatic play using CH1 to CH3 and also selects one key out of the depressed keys (for example, the key depressed first) and supplies the gating signal for tone generation G4 synchronized with the depression and release of that key and the pitch data N4 corresponding to that key to the remaining channel CH4. Channel CH4 generates the musical tone signal of the pitch based on the supplied pitch data N4 synchronized with the gating signal of tone generation G4 to enable manual monophonic play in real time.

When one wants to manually play a melody part which is performed on automatic play using CH1 and CH2, channel-use assigning device 3 is operated to change over CH1 and CH2 to the manual play side M. This changeover is, as one example, performed by the use of four switches corresponding to CH1 to CH4. Along with the changeover operation, channel assigner 4 supplies to channel CH3 the pitch data N3 and gating signal for tone generation G3, to be supplied to channel CH3 based on the automatic play data, synchronized with the tempo of the automatic of play and selects a maximum three keys out of the keys depressed in manual play (for example, the maximum three keys depressed first), assigns one channel each out of channels CH1, CH2, and CH4 to those selected keys, and supplies the gating signals for tone generation G1, G2, and G4 synchronized with the depression and release of the keys and the pitch data N1, N2, and N4 to the channels to which they were respectively assigned. Through this, channel CH3 generates the automatic play musical tone signals synchronized with the automatic play tempo based on the automatic play data to be handled by channel CH3, and channels CH1, CH2, and CH4 generate the manual play musical tone signals synchronized with the depression and release of respectively assigned keys along with the keyboard operation by manual play. That is, it becomes possible to play together with a monophonic automatic play using a real time manual polyphonic play of a maximum of three simultaneous tone generations.

Next, a detailed explanation is given of the various composite conditions.

First, an explanation is given of an application example of channel assigner 4.

An application example of channel assigner 4 of FIG. 1 is discussed here. Element 7 is the automatic play channel assigner, and reads the automatic performance data stored in automatic play data memory 2 so as to output pitch data Na1 to Na4 and gating signals for tone generation Ga1 to Ga4 corresponding to the channels 5 assigned for automatic play; and at the same time outputs automatic play assignment channel data Da indicating which channels have been assigned for automatic play. This automatic play assignment channel data Da is composed of 4 bits, and is outputted to four bus lines, and each bit corresponds to CH1 to channels CH4.

When, for example, a logical "1" signal (high level voltage) appears in the line corresponding to channel CHn, it means that channel CHn has been assigned for automatic play and when a logical "0" signal (low level voltage) appears, it means that channel CHn can be used for manual play.

Element 8 is the channel-use data generator, and, based on the automatic play assignment channel data Da and the assignment data De of the channel-use assigning device 3, outputs channel-use data $D_{CH}$ indicating which of chanels 5-1 to 5-4 can be used for automatic play. In the application example of FIG. 1, the channel-use assigning device 3 is formed from the four switches 3-1 to 3-4 attached corresponding to CH1 to CH4, and the voltages at the terminals of these switches 3-1 to 3-4 compose the 4 bit assignment data De. Usually, this is on the "A" (auto play) side, as shown in FIG. 1, and all lines of the assignment data De are "1" (high level voltage). When desiring to change over the channels used for automatic play to manual play, one changes the switches corresponding to those channels to the "M" (manual play) side.

Through this, of the four lines of assignment data De, only that line corresponding to the channel changed over to manual play becomes "0" (low level voltage).

Now, channel assignment data generator 8 is, as shown in the application example of FIG. 1, formed from four AND circuits 8-1 to 8-4 corresponding to channels CH1 to CH4, which AND the signals on the lines, corresponding to each channel, of the automatic play assignment channel data Da and the above assignment data De so as to output the 4 bit composition channel-use data $D_{CH}$. The above data Da, De, and $D_{CH}$ are expressed in 4 bits, and channels CH1 to CH4 are matched from LSB to MSB. Now, when automatic play is assigned to channels CH1 to CH3, Da becomes 0111. When switches 3-1 to 3-4 of the channel-use assigning device 3 are all set to the "A" side, De is 1111 and the output data $D_{CH}o$ of the channel-use data generator 8 becomes 0111, indicating that channels CH1 to CH3 can be used for automatic play and channel CH4 can be used for manual play. When switches 3-1 and 3-2 are changed to the "M" side, the selection data De changes to 1100 and the channel-use date $D_{CH}$ becomes 0100 as a result of the ANDing of Da and De, indicating that channels CH1, CH2, and CH4 can be used for manual play and channel CH3 can be used for automatic play.

Element 6 is the manual play channel assigner, and, based on the selection data of the keyboard (pitch selecting device 1), generates pitch data Nm1 to Nm4 and gating signals for tone generation Gm1 to Gm4 which should be assigned for the manual play channels indicated by the channel-use data $D_{CH}$.

Figure 5:
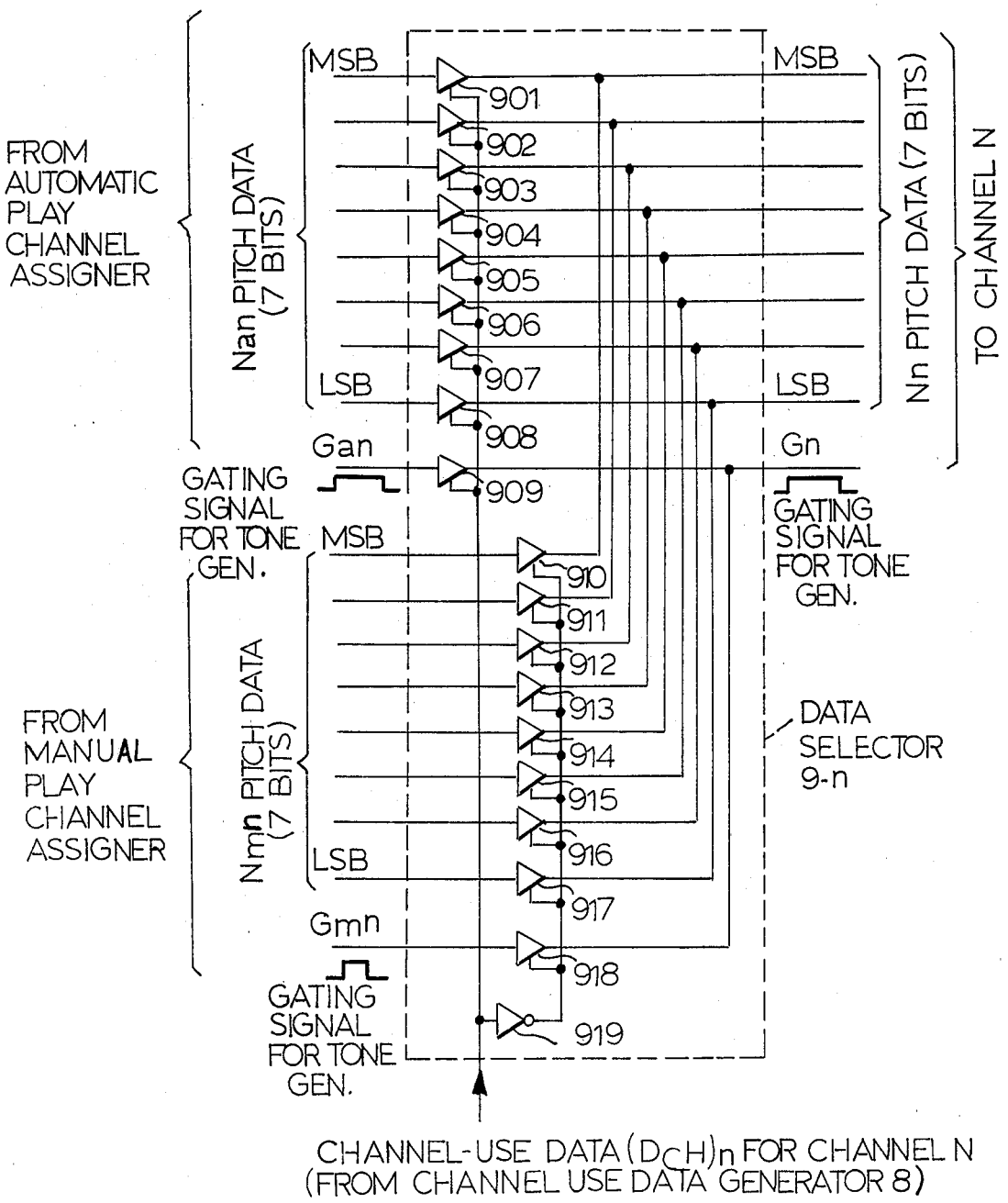
FIG. 5 is a circuit diagram of an actual application example of a data selector 9–n.

Element 9 is the data supplier, and inputs the pitch data Na1 to Na4 and the gating signals for tone generation Ga1 to Ga4 outputted from the automatic play channel assigner 7 and the pitch data Nm1 to Nm4 and the gating signals for tone generation Gm1 to Gm4 outputted from the manual play channel assigner 6. Data supplier 9, following the channel-use data $D_{CH}$, matches and supplies the pitch data Na1 to Na4 and the gating signals for tone generation Ga1 to Ga4 to the channels used for automatic play and matches and supplies the pitch data Nm1 to Nm4 and the gating signals for tone generation Gm1 to Gm4 to the channels used for manual play. In the application example of FIG. 1, data supplier 9 is formed from data selectors 9-1 to 9-4, which are attached to corresponding channels CH1 to CH4. FIG. 5 shows the actual circuit structure of data selector 9–n (n=1 to 4). Elements 901 to 918 are tri-state buffers which buffer and output the input signals when the enable control signal is "1" and which make the output high impedance when the signal is "0". Element 919 is an inverter. The output of tri-state buffers 901 to 909 are respectively wire "OR"ed with the output of tri-state buffers 910 to 918, and become the output of data selector 9–n. The output Nn (pitch data supplied to channel n) and Gn (gating signal of tone generation for same) of the data selector 9–n become equivalent to Nan (pitch data outputted for channel n from automatic play channel assigner 7) and Gan (gating signal of tone generation for same) when the signal $(D_{CH})$n for channel n of channel-use data $D_{CH}$ is "1" and only buffers 901 to 909 become enabled and become equivalent to Nmn (pitch data outputted for channel n from manual play channel assigner 6) and Gmn (gating signal of tone generation for same) when $(D_{CH})$n is "0" and only buffers 910 to 918 become enabled.

Now, automatic play channel assigner 7 not only reads information on the pitch and length of the note of the tone scale of the automatic play from the automatic play data memory 2 but also reads the information on the tone color, i.e.—what tone color to make the note of the tone scale. From this information, the assigner outputs automatic play tone color assignment data Ta which stipulates which channel should be set to what tone color.

Element 10 is the manual play tone color selector for selecting and setting the tone color of the manual play tone. It has a function similar to the "tone tablets" of conventional electronic organs and outputs manual play tone color selection data Tm indicating what tone colors have been selected.

Element 11 is the tone color assigner, and inputs the above-noted automatic play tone color assignment data Ta, the manual play tone color selection data Tm, and the channel-use data $D_{CH}$. This tone color assigner 11, based on the channel use data $D_{CH}$, supplies the musical tone synthesizing parameters TP created based on the automatic play tone color assignment data Ta to the channels used for automatic play. Tone color assigner 11 supplies musical tone synthesizing parameters TP, created so as to be based on the manual play tone color selection data Tm, to the channels used for manual play.

Musical tone signal generating channels 5-1 to 5-4 synthesize musical tone signals by the musical tone synthesizing parameters TP1 to TP4 and supplied pitch data N1 to N4 and output these musical tone synchronized with the gating signals of tone generation G1 to G4.

Next, a detailed explanation is given of the automatic play channel assigner 7.

Figure 2A:
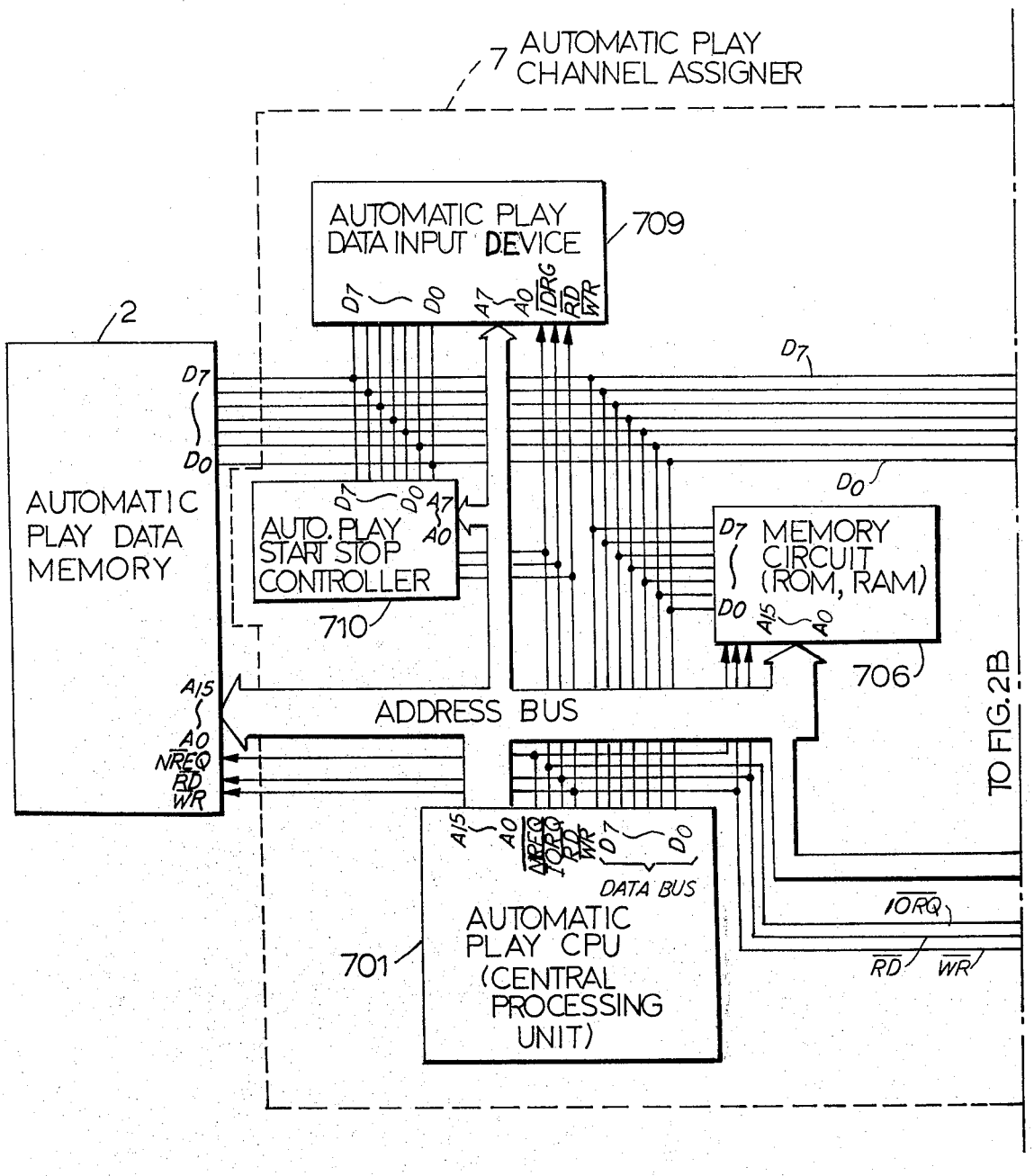
FIGS. 2*a* and 2*b* illustrate a circuit diagram of an actual application example of an automatic play channel assigner 7.
Figure 2B:
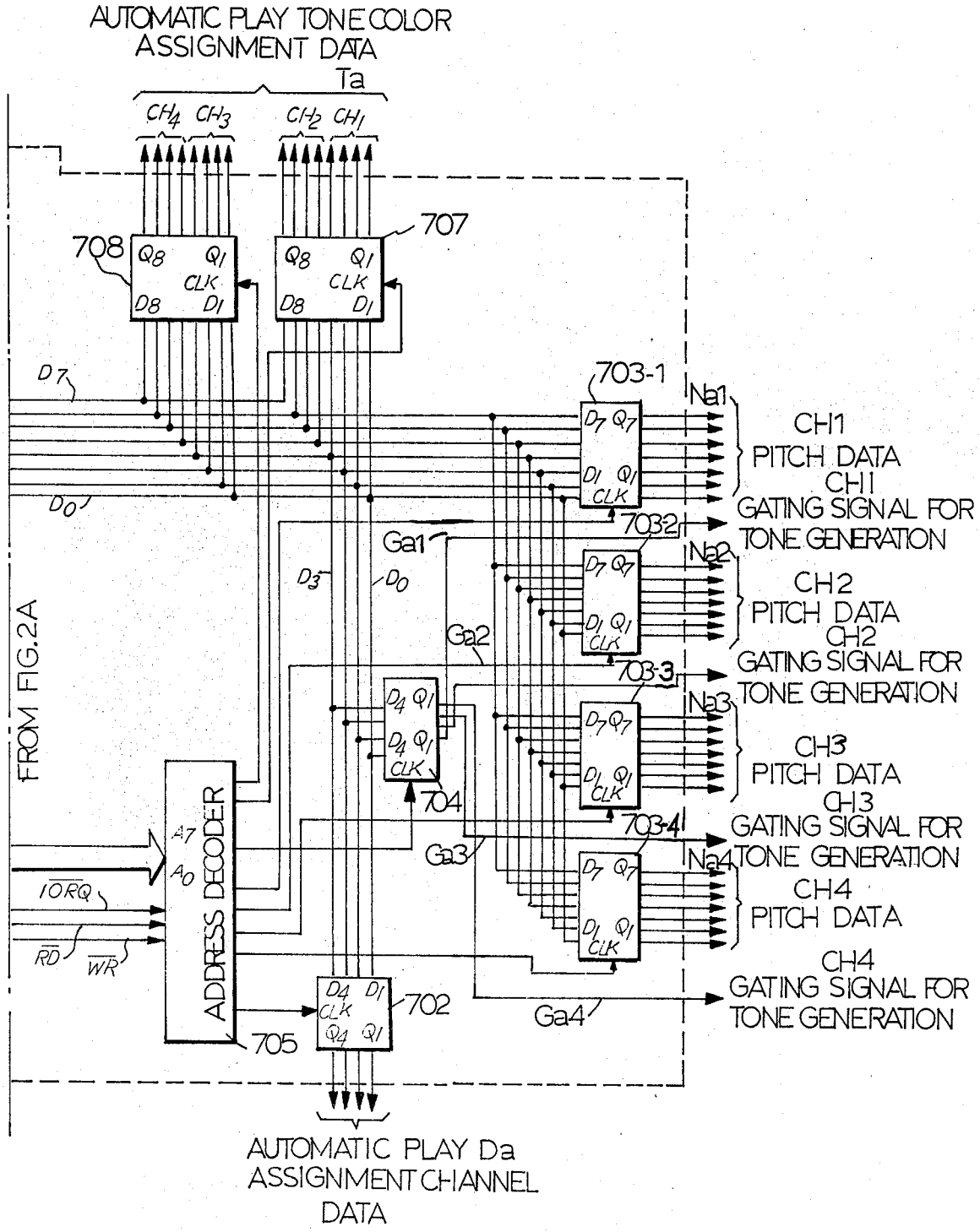

FIGS. 2*a* and 2*b* show the circuit structure of a concrete application example of the automatic play channel assigner 7.

Element 701 is the automatic play CPU (central processing unit) and executes the commands programmed for automatic play processing. It can be realized, for example, with the microcomputer Z80 CPU of the Zilog Company.

Element 706 is a memory circuit formed from a ROM and RAM for working in which is stored the automatic play processing program.

Element 705 is the I/O address decoder. Element 702 is a 4 bit automatic play assignment channel data latching circuit which latches and outputs automatic play assignment data Da. Elements 703-1 to 703-4 are 7 bit pitch data latching circuits latching and outputting automatic play pitch data Na1 to Na4 assigned so as to correspond to channels CH1 to CH4.

Element 704 is a 4 bit latching circuit for gating signals for tone generation which latches and outputs automatic play gating signals for tone generation Ga1 to Ga4. Elements 707 and 708 are latching circuits for tone color assignment data which latch and output the automatic play tone color assignment data Ta.

Element 709 is the automatic play data input device, used to memorize the performance data of the music one wishes to have automatically played into the automatic play data memory 2.

Element 710 is the automatic play start/stop control for starting or stopping the automatic play.

Next, a simple explanation is given of the operation of the application example of FIGS. 2*a* and 2*b*.

First, an explanation is given of the pitch data, the note length code, and the tone color number.

FIG. 8 shows the pitch data table. The pitch data is a 7 bit composition, not including 0000000. The upper 3 bits indicate the octave number and the lower 4 bits indicate the 12 semi-notes in the octave. The note range extends over the 61 semi-notes of C1 to C6. For example, E3 is expressed by 0110101 and G2 is expressed by 0101001.

FIG. 9 shows the note length code table and FIG. 10 the tone color number table.

Figure 6:
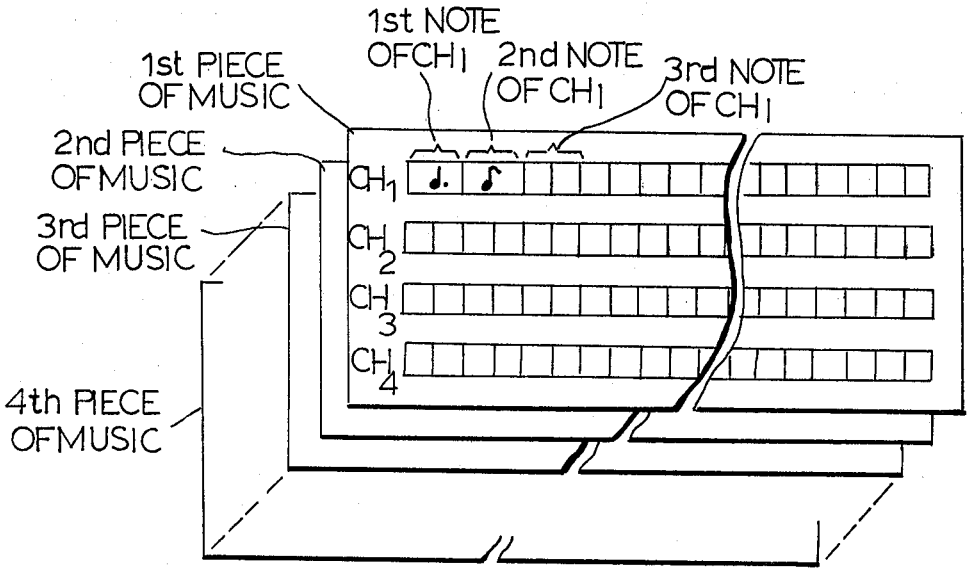
FIG. 6 is a diagram showing the memory construction of automatic play data memory 2.
Figure 7:
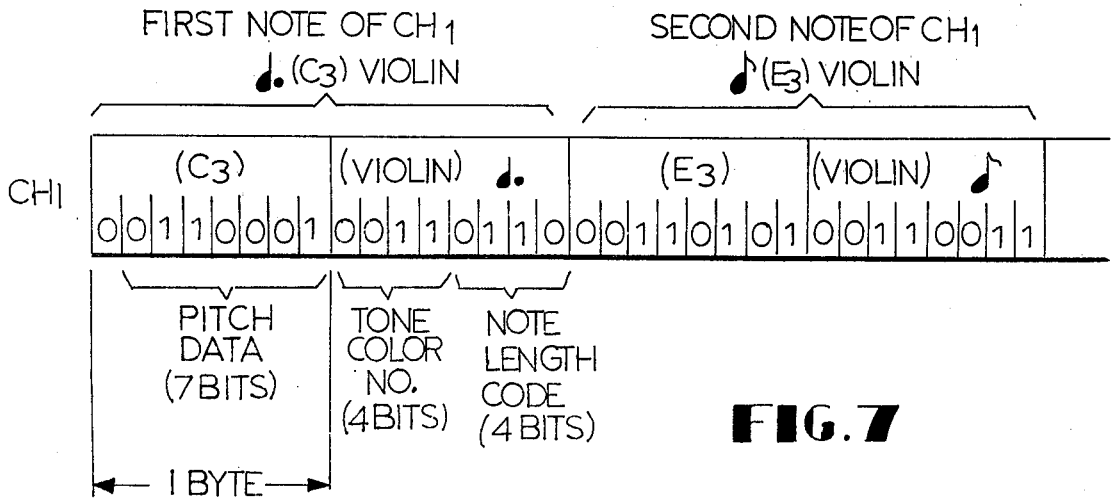
FIG. 7 is a diagram showing an example of the composition of note data, expanded from part of FIG. 6.

FIG. 6 shows the memory composition of the automatic play data memory 2. The automatic play data memory 2 is divided roughly by music and the memory areas of each piece of music is further subdivided by the four parts for channels CH1 to CH4. Inside the subdivided part areas, the data on the notes of the tone scale is arranged in order of performance. Each single note (including rests) is composed of two bytes. FIG. 7 shows a structural example of data on notes of the tone scale. FIG. 7 is an expansion of the front section of the CH1 area of the first piece of music of FIG. 6. The example shown is of the first note for channel CH1, a violin tone of length d and pitch C3, and of the second note, a violin tone of length d and pitch E3. At rest, the pitch data is 0000000 and the note length code is not 0000.

Judgement of when there is no note input is made when everything becomes zero.

When the information on the music score is inputted using the automatic play data input device 709, that information is subjected to the automatic play data storage processing of the CPU 701 and stored in the automatic play data memory 2 as shown in FIG. 6.

Before the start of automatic play, data 0000 is latched in the latching circuit for automatic play assignment channel data 702 and data 0000 is latched in the latching circuit for gating signal for tone generation 704, in the sense of indicating that all the channels can be used for manual play, by processing of CPU 701.

Now, when the automatic play start/stop controller 710 receives the start operation command, CPU 701 detects this and reads the corresponding data out of the addresses of the automatic play data memory 2, starting with the address of the music assigned by the automatic play start/stop controller 710.

Look, for example, at the channel CH1 to CH4 area of the area of the first piece of music of automatic play data memory 2 when the first piece of music is assigned.

In the case where the note data entered is for a violin part for channel CH1, a flute part for channel CH2, and an oboe part for channel CH3 and the channel CH4 area is all zeros without any input, the processing by CPU 701 causes the latching circuit for automatic play channel data 702 to be latched with data Da 0111 and the latching circuits for tone color assignment data 707 and 708 to be latched with 00000101 and 00010011 data Ta respectively.

Synchronized with the tempo of automatic play, latching circuits for pitch data 703-1 to 703-3 (no 703-4 since there is no input in the channel CH4 area) are latched with 7 bit composition pitch data Na1 to Na3 based on the data of the notes of the tone scale read from the automatic play data memory 2; at the same time latching circuit for gating signals for tone generation 704 is latched with the gating signals for tone generation Ga1 to Ga3 calculated so as to be based on the note length code of the channel CH1 to CH3 areas. However, in the case of the note data of FIG. 7, 0110001 C3 pitch data Na1 is latched into the latching circuit for pitch data 703-1 for CH1 when automatic play commences.

When the automatic play start/stop controller 701 is operated for automatic play stop, the CPU 701 detects this, latches data 0000 into the latching circuit for gating signals for tone generation 704 so as to prevent the tone generation of automatic play channels, and latches data Da of 0000 into the latching circuit for automatic play assignment channel data 702 so as to release all channels for manual performance.

The concrete application example of the automatic play channel assigner 7 explained above with FIGS. 2*a* and 2*b* clearly can be easily realized by a combination of publically known technologies. Further, the idea of an automatic player (or composer) using a microcomputer is also public knowledge as evidenced by the Roland Company's "microcomposer."

Next, a detailed explanation is given on the manual play channel assigner 6.

Figure 3A:
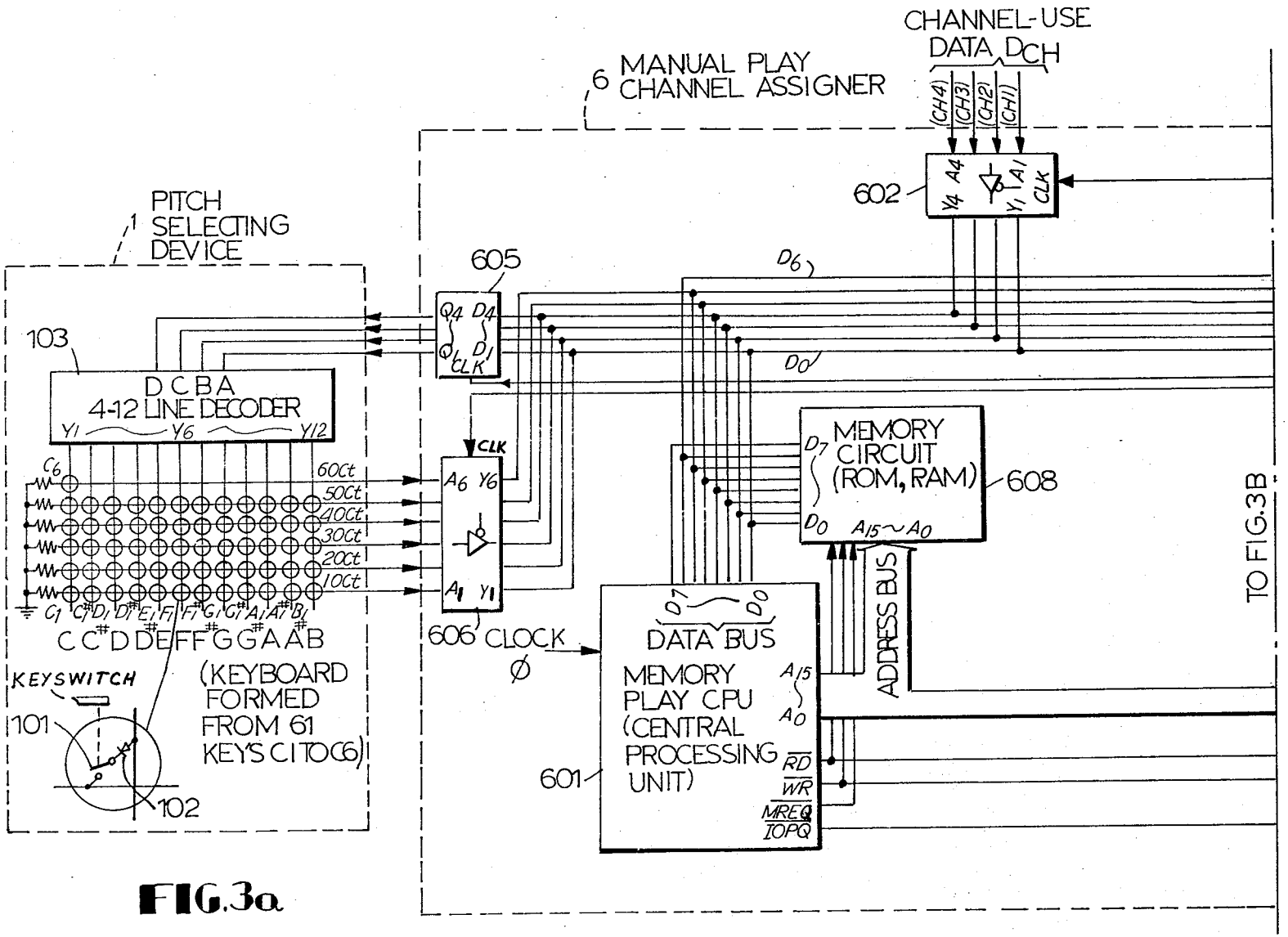
FIGS. 3*a* and 3*b* illustrate a circuit diagram of an actual application example of a pitch selecting device 1 and manual play channel assigner 6.
Figure 3B:
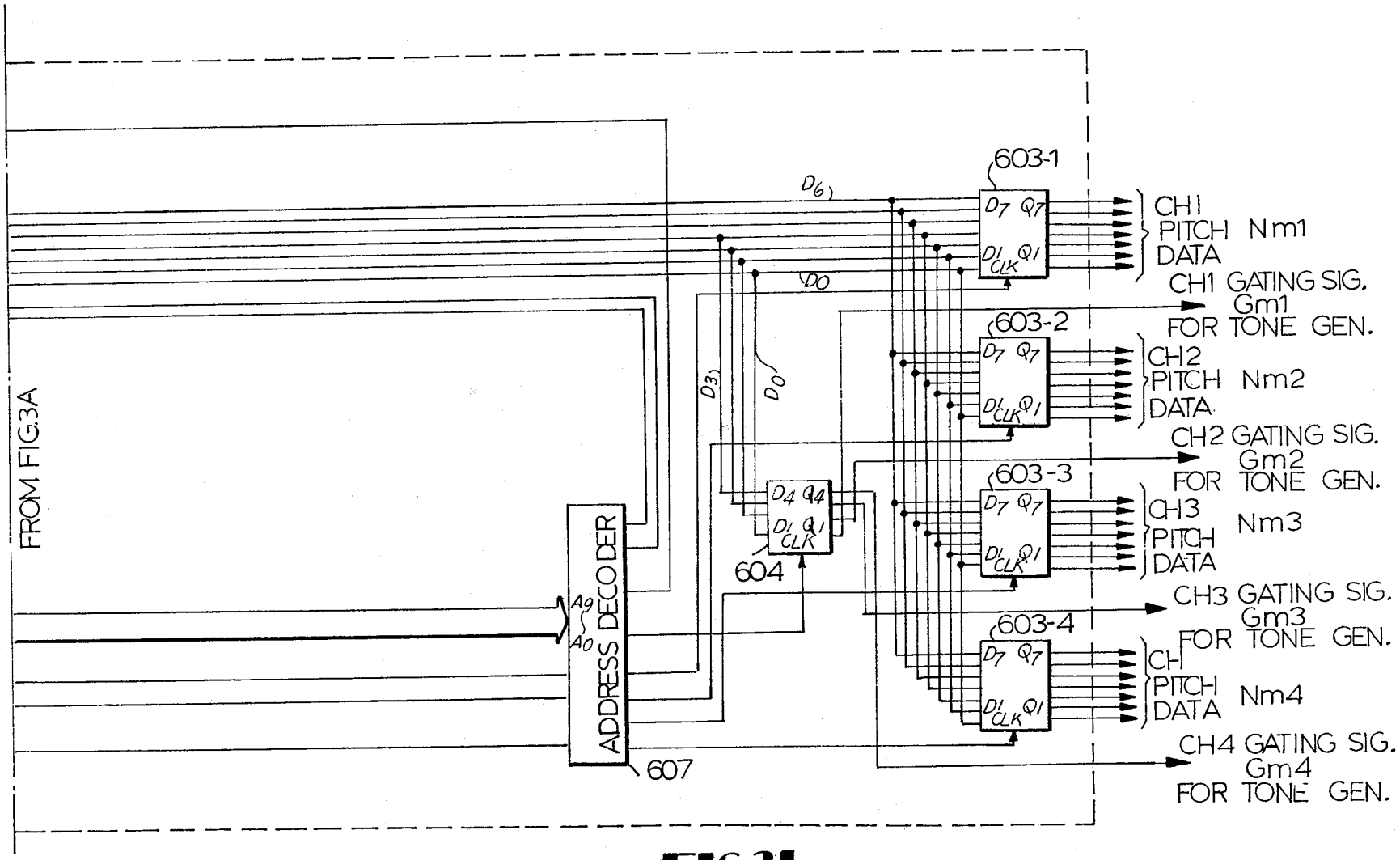

FIGS. 3*a* and 3*b* shows the circuit composition of an actual application example of an automatic play channel assigner 6 and pitch selecting device 1.

Element 601 is the manual play CPU (centra processing unit) and executes the commands programmed for manual play processing. For example, it can be realized by the Zilog Company's microcomputer Z80 CPU. Element 608 is a memory circuit formed from a ROM and RAM for working in which is stored the manual play processing program. Element 607 is the I/O address decoder. Elements 603-1 to 603-4 are the latching circuits for 7 bit pitch data which latches and outputs the manual play pitch data Nm1 to Nm4 assigned according to channels CH1 to CH4 respectively. Element 604 is the latching circuit for 4 bit gating signals for tone generation which latches and outputs gating signals for tone generation for manual play Gm1 to Gm4. Element 602 is the tri-state buffer circuit for reading in channel-use data $D_{CH}$. Element 605 is the chromatic latching circuit for scanning pitch selecting device 1 and element 606 is the tri-state buffer circuit for reading in that scanning data.

Next, a detailed description is given of the pitch selecting device 1.

In this application example, the pitch selecting device 1 is a keyboard including 61 keyswitches corresponding to notes C1 to C6.

In FIGS. 3*a* and 3*b*, these 61 keyswitches are arranged in a 12×6 matrix (intersections enclosed in circles), and one of those keys is 101. Element 102 is one diode for the prevention of crosstalk of voltage when several keys are depressed simultaneously. Element 103 is the 4-12 line decoder; only the output line corresponding to the binary number of the input digital signal becomes 1 (high level voltage). Therefore, for example, if the chromatic latching circuit 605 latches and outputs the note F data 0110 (see FIG. 8 Pitch Data Table), then only the output line of Y6, that is F (note F) becomes 1 and the other output lines all become 0 (low level voltage). Here, when the keyswitch 101 of note F1 is on, diode 102 is charged and only the 1 oct. line becomes 1, and the signals read on the lines of the 1st octave to 6th octave become 000001 through buffer 606.

That is, if the 6 bit data carried on the lines of the 1st octave to 6th octave are read from buffer 606 each time the 12 data 0001 (C), 0010 (C#), 0011 (D) . . . 1100 (B) (see Table 8 Pitch Data Table) are latched successively on chromatic latching circuit 605, then it is possible to detect which keys of the 61 keys corresponding to notes C1 to C6 have been depressed. This operation of detecting the keyswitches is called the key scanning operation.

Manual play CPU 601 reads the channel used data $D_{CH}$ from the buffer 602 and executes manual play by latching into the latching circuit for pitch data 603 and latching circuit for gating signals for tone generation 604, for the channels corresponding to the 0 bits of $D_{CH}$, the pitch data and gating signals for tone generation assigned for the depressed keys, detected by the above-noted key scanning operation. For example, when $D_{CH}$ equals 0001, manual play of three notes, the maximum number of notes which can be simultaneously generated, becomes possible using the three channels CH2 to CH4.

The manual play channel assigner of the application example of FIG. 3 operates as follows:

(1) It assigns depressed keys only for channels corresponding to the 0 bits of channel use data $D_{CH}$ (channels which can be used for manual play). If n is the number of channels which can be used for manual play, (2) The maximum number of notes which can be simultaneously generated is n. That is, the effective number of keys which can be depressed simultaneously is n keys.

(3) The channel unoccupied last is assigned for the newly depressed keys.

(4) The channels assigned to the depressed keys are not released so long as those keys are not released.

(5) When two or more keys are depressed at exactly the same time, assignment is made with priority given to lowest note key up. The operation of the manual play channel assigner 6 is explained using a flow chart.

Figure 11:
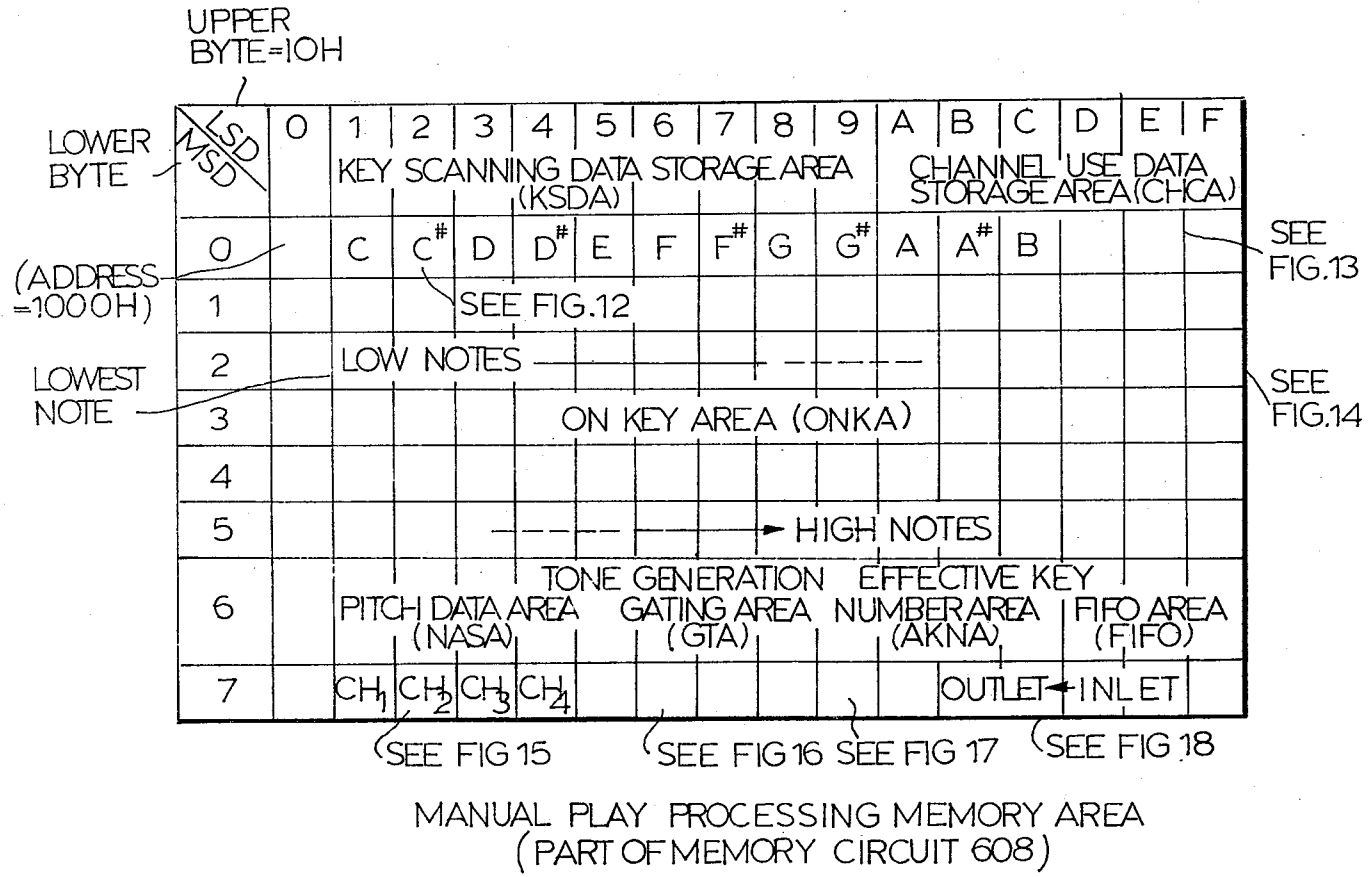
FIG. 11 is a diagram showing the memory area for manual play processing.

FIG. 11 shows an example of the memory area for manual play processing. Each area is laid out for ease of understanding in explanation. The H attached at the end of the address data indicates that the number is expressed in hexadecimal notation.

Figure 12:
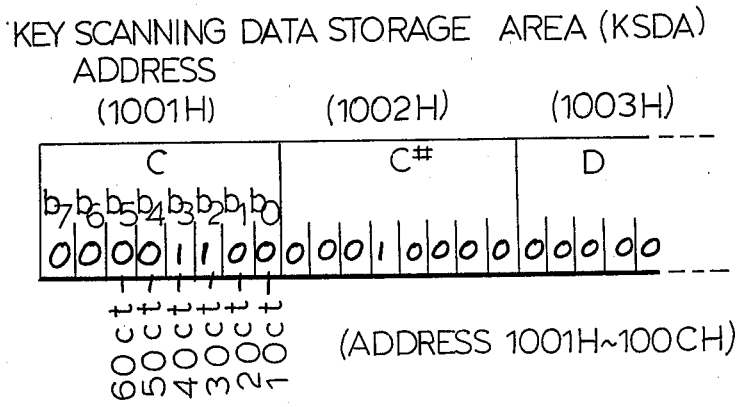
FIG. 12 is a diagram showing the key scanning data storage area (KSDA)

Areas 1001H to 100CH are key scanning data areas (KSDA) provided corresponding to notes C to B respectively. These areas store the 6 bit composition 12 word key scanning data (KSD) written in at the key scanning operation. FIG. 12 shows the detailed memory construction. FIG. 12 shows the case when keys C3, C4 and C5# are depressed.

Figure 13:
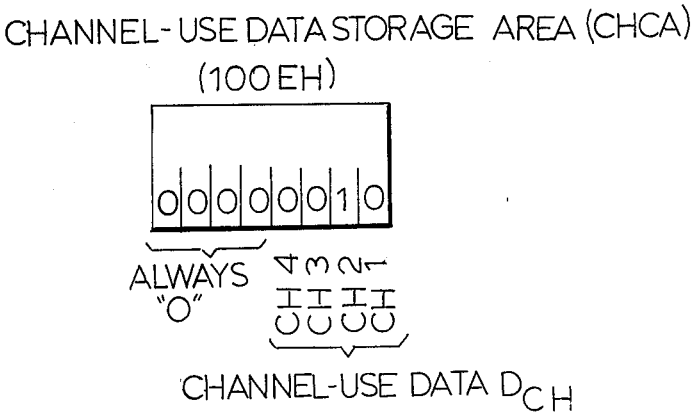
FIG. 13 is a diagram showing the channel use data storage area (CHCA)

Area 100EH is a channel use data storage area (CHCA) for the writing in and storage of channel use data $D_{CH}$, Its detailed memory construction is shown in FIG. 13. In FIG. 13, the channel use data $D_{CH}$ means manual play channels when O and automatic play channels when 1.

Figure 14:
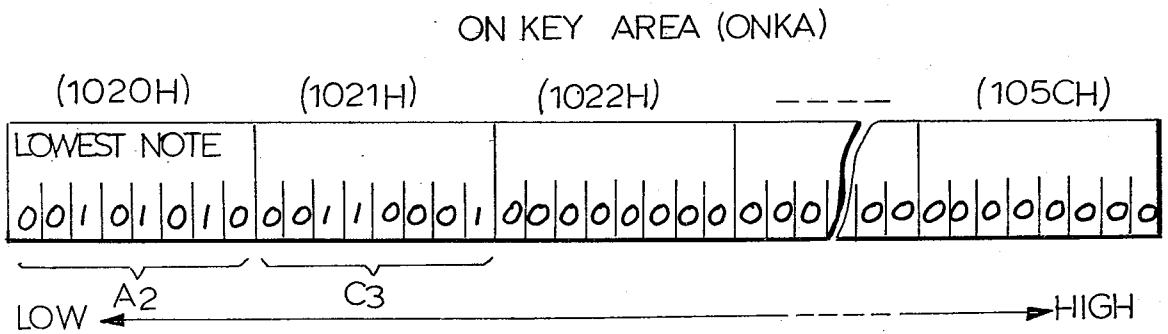
FIG. 14 is a diagram showing the on-key area (ONKA)

Areas 1020H to 105CH are on key areas (ONKA) for inserting the pitch data corresponding to the depressed keys from 1020H in order of the lowest pitch, and are composed of 61 bytes, matching the number of keys on the keyboard. Their detailed memory construction is shown in FIG. 14. In the on key areas (ONKA), the pitch data (7 bits) corresponding to the on keys are written in starting from 1020H in order of lowest pitch. In FIG. 14, keys A2 and C3 are on, and the pitch data of the lower A2 0101010 is written into 1020H and that of C3 011001 is written into 1021H. 1022H to 105CH all become 00H.

Figure 15:
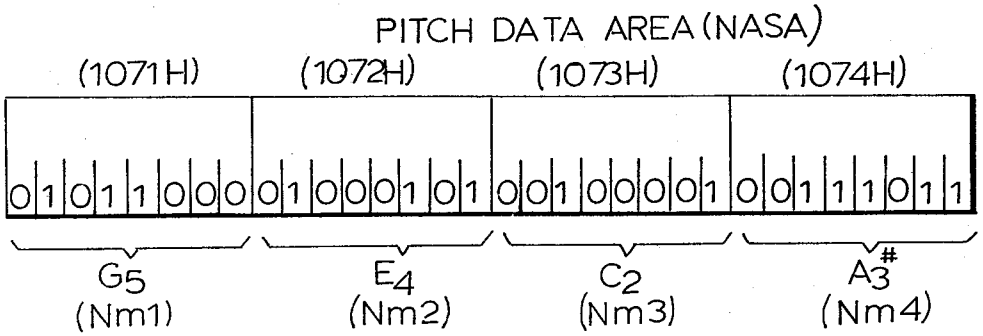
FIG. 15 is a diagram showing the pitch data area (NASA)

Areas 1071H to 1074H are the pitch areas (NASA) provided corresponding to channels CH1 to CH4 respectively, and are for setting pitch data Nm1 to Nm4, which should be supplied to each channel, after assignment processing. Their detailed memory construction is shown in FIG. 15. FIG. 15 shows the case where pitch data G5, E4, D2, and A3# are respectively assigned to channels CH1 to CH4.

Figure 16:
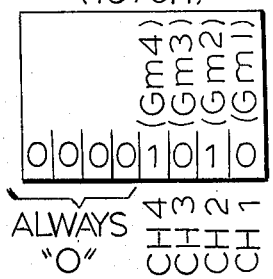
FIG. 16 is a diagram showing the tone generation gating area (GTA)

Area 1076H is for setting the gating signals for tone generation Gm1 to Gm4 which should be supplied to each channel after assignation processing. Its detailed memory construction is shown in FIG. 16. This simultaneously shows that the assignation of keys has been determined for channels CH2 and CH4.

Figure 17:
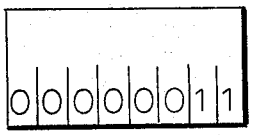
FIG. 17 is a diagram showing the effective key number area (AKNA)

Area 1079H is an effective key number area (AKNA) showing the number of empty channels which can be assigned at the present time, that is, the effective number of keys which which produce notes even when depressed from now. Its detailed memory construction is shown in FIG. 17. In FIG. 17, there are three depressed keys, obtained in accordance with the CH assignment. In this area, only five kinds of data, 00H to 04H, can be entered.

Figure 18:
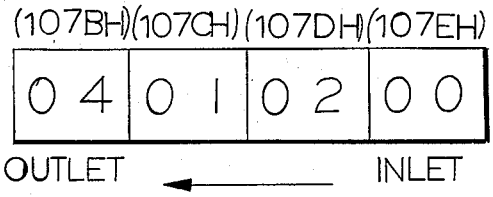
FIG. 18 is a diagram showing the FIFO area (FIFO)

Areas 107BH to 107ED are first-in first-out areas (FIFO) which perform FIFO operation with 107EH as the inlet and 107BH as the outlet. Their detailed memory construction is shown in FIG. 18. In FIG. 18, the 04 of 107BH indicates that the CH number to be next assigned is 4. In the same way, the 01 and 02 of 107CH and 107DH indicate channels CH1 and CH2 respectively. Furthermore, the released (unoccupied) CH number is set into 107EH. In this area too, only five kinds of data, 00H to 04H, can be entered.

Figure 19:
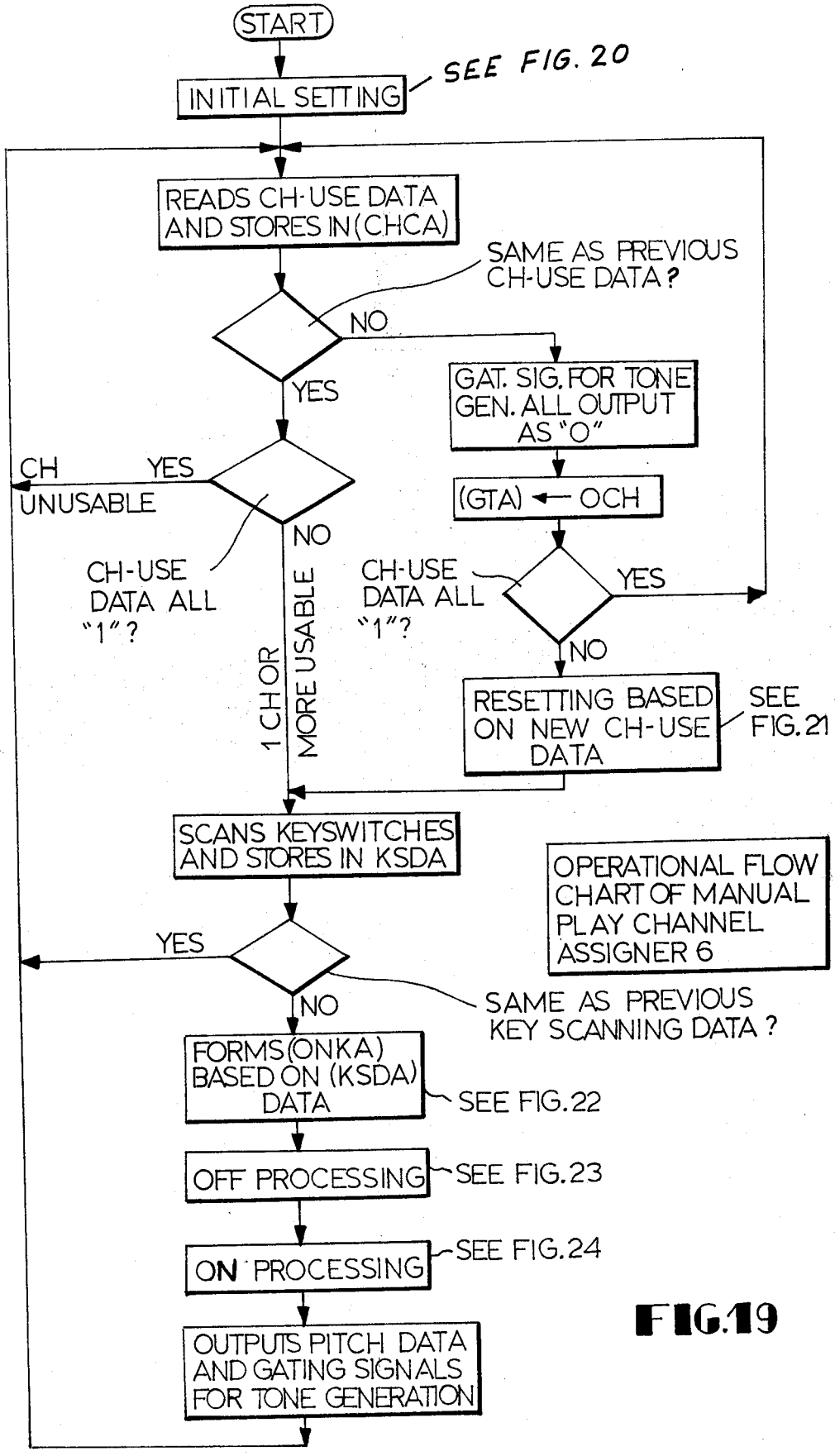
FIG. 19 is a diagram showing the operational flow chart of manual play channel assigner 6.
Figure 20:
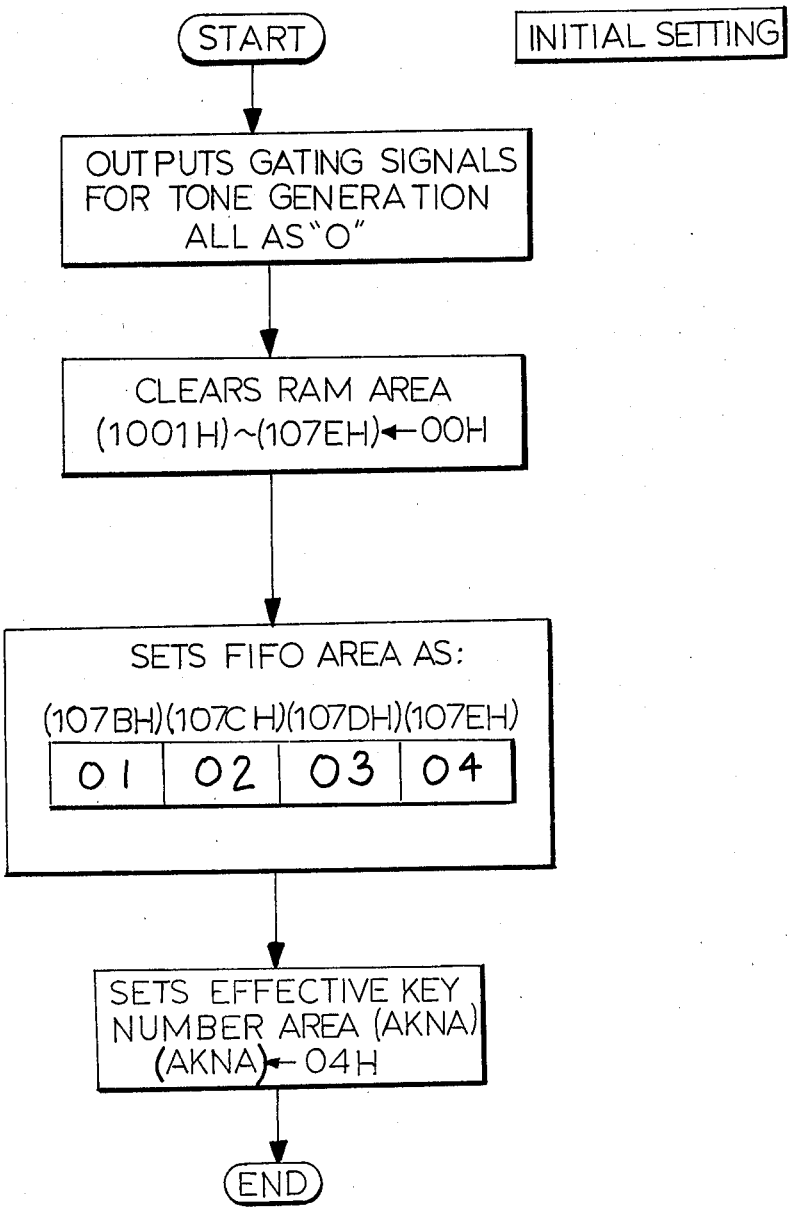
FIG. 20 is a diagram showing the detailed flow chart of the "initial setting,"
Figure 21A:
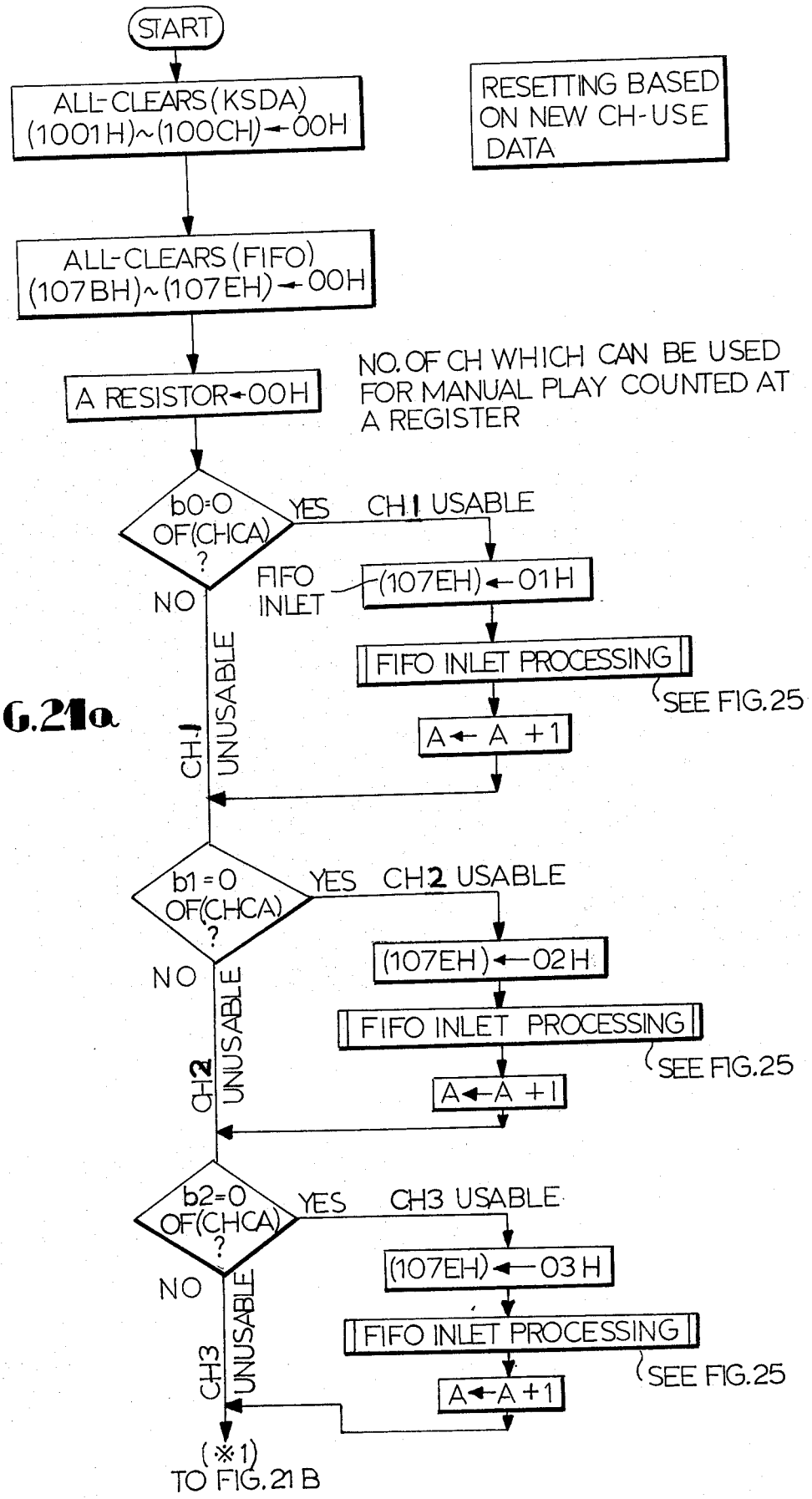
FIG. 21*a* and FIG. 21*b* are diagrams showing detailed flow charts of "resettings based on new CH use data"
Figure 21B:
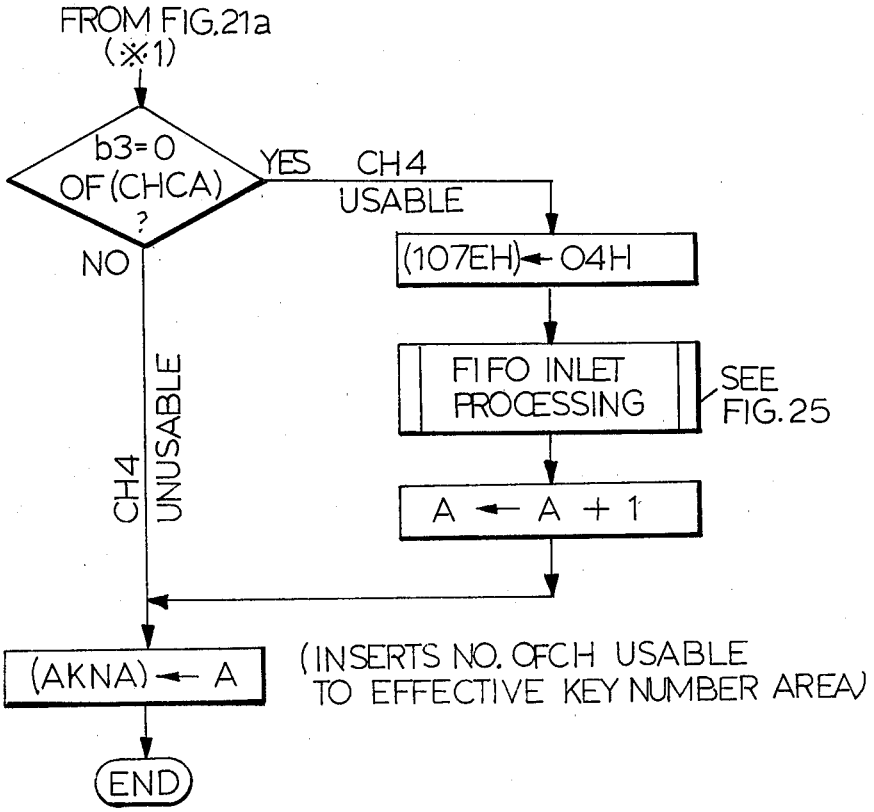
Figure 21C:
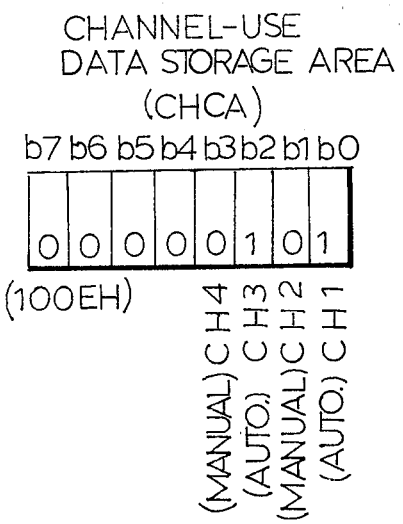
FIG. 21*c* and FIG. 21*d* are diagrams showing examples of the same.
Figure 21D:
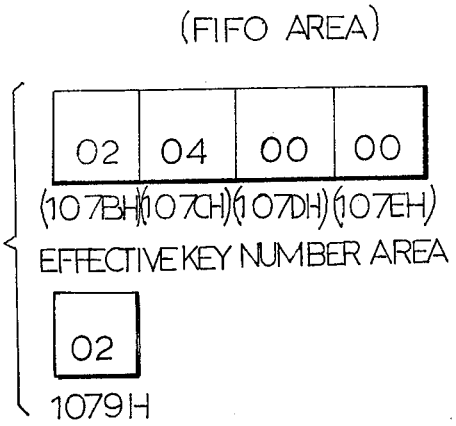

FIG. 19 shows a flow chart of the operation of manual play channel assigner 6. FIG. 20 shows a detailed flow chart of the "initial setting," and FIGS. 21*a* and 21*b* show detailed flow charts of "resettings based on the new channel use data." FIGS. 21*c* and 21*d* show, in accordance with the flow charts of FIGS. 21*a* and 21*b*, the resetting of the first in first-out area (FIFO) and effective key number area (AKNA) based on the data of the channel-use data storage area (CHCA).

FIG. 22*a* shows a detailed flow chart of the "formation of ONKA, based on the data of KSDA." In accordance with the flow charts of FIGS. 22*b*, 22*c*, and 22*a*, it shows the setting of the on key area (ONKA) based on the key scanning data storage area (KSDA), when keys G2, A2, D3, and E3 are depressed.

Figure 23A:
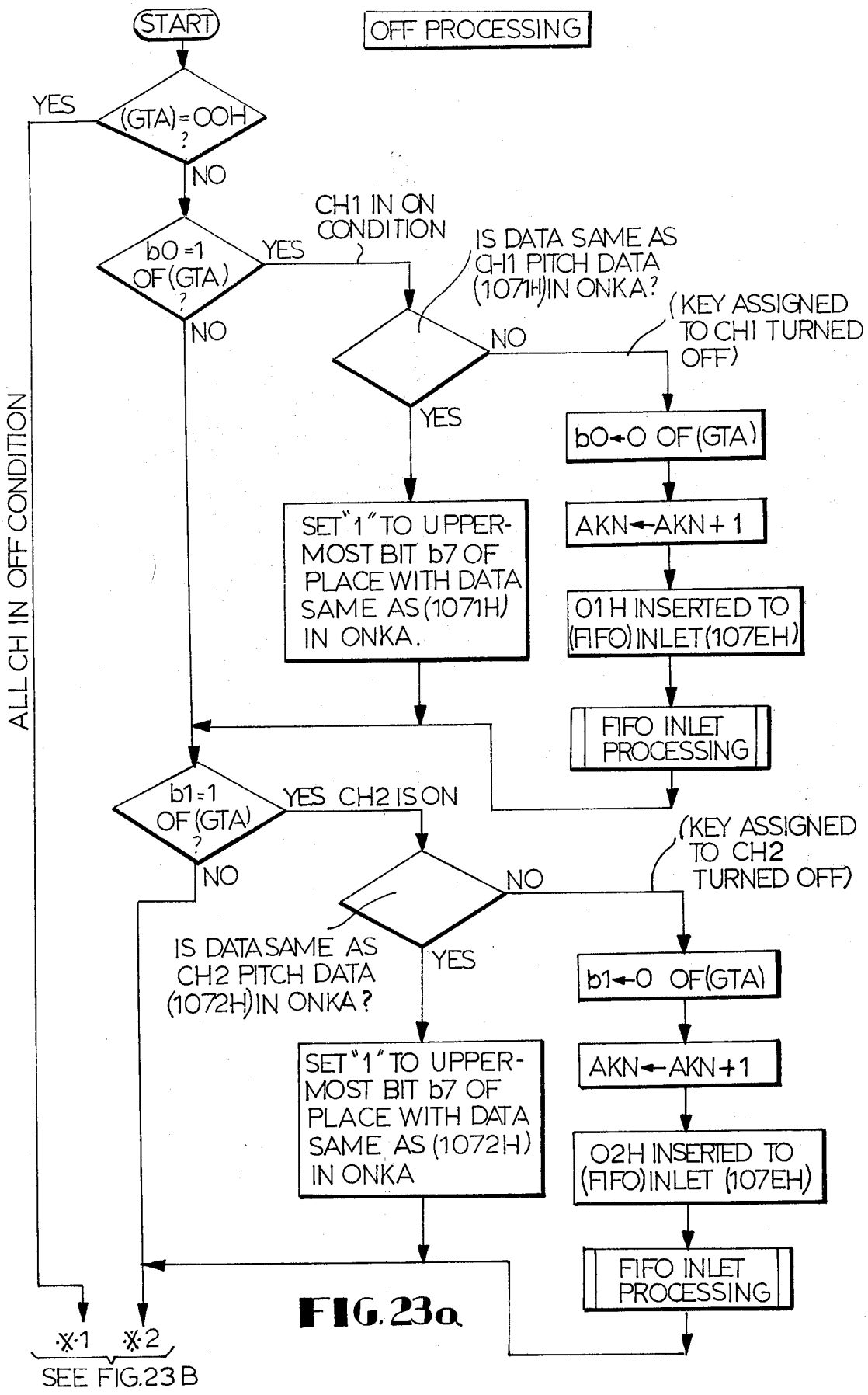
FIG. 23*a* and FIG. 23*b* are diagrams showing detailed flow charts of "off processing"
Figure 23B:
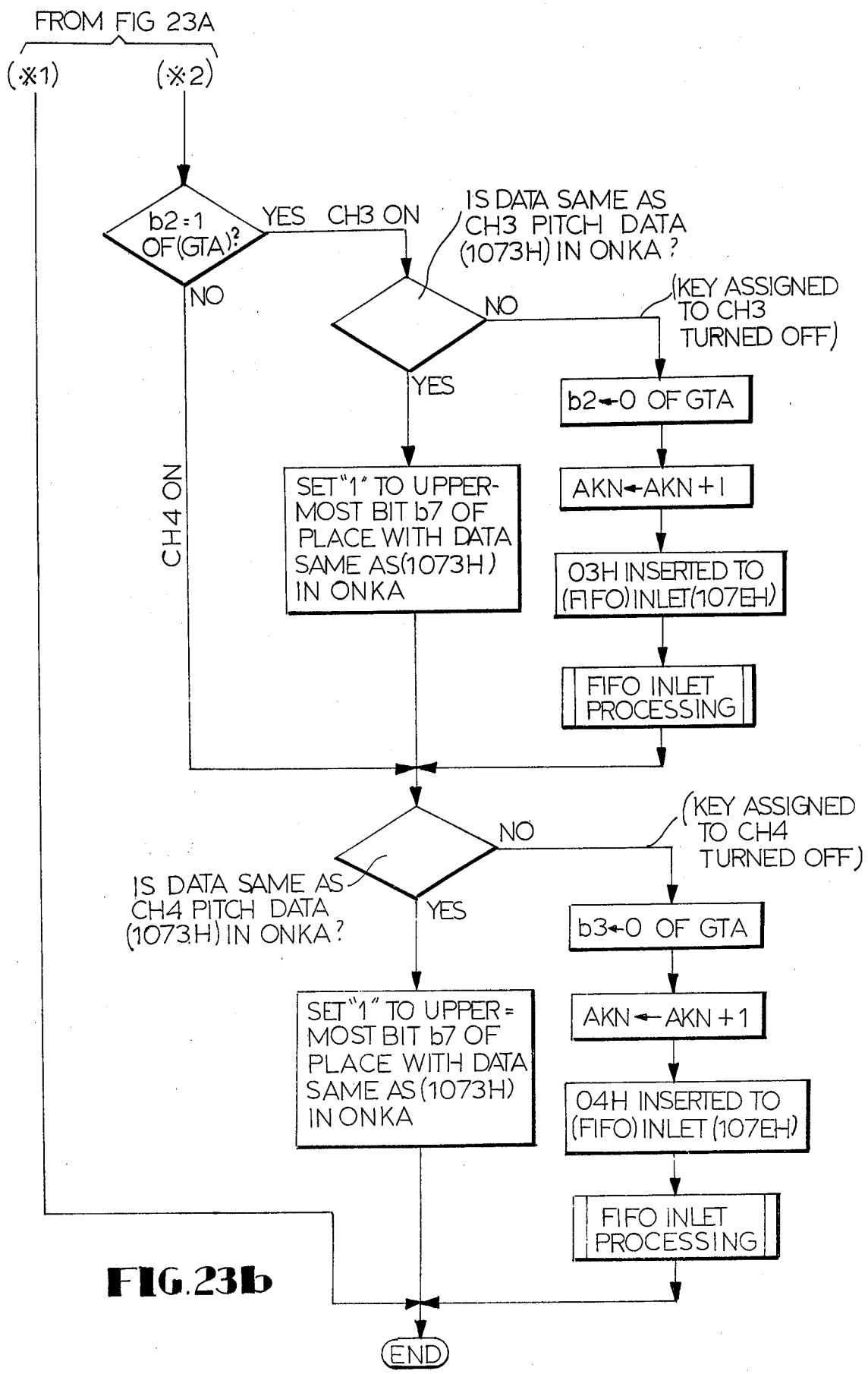
Figure 24:
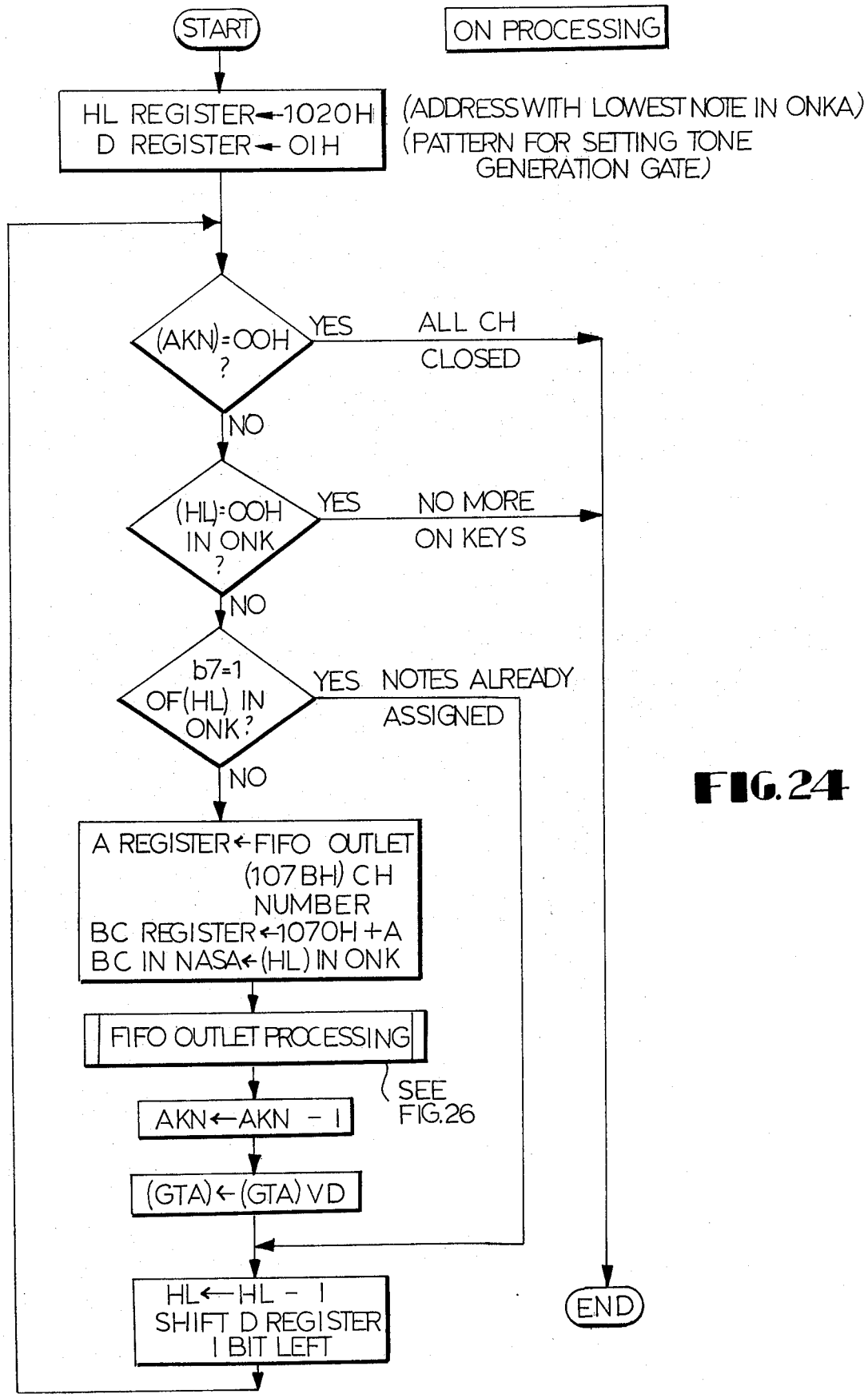
FIG. 24 is a diagram showing a detailed flow chart of "on processing"
Figure 25A:
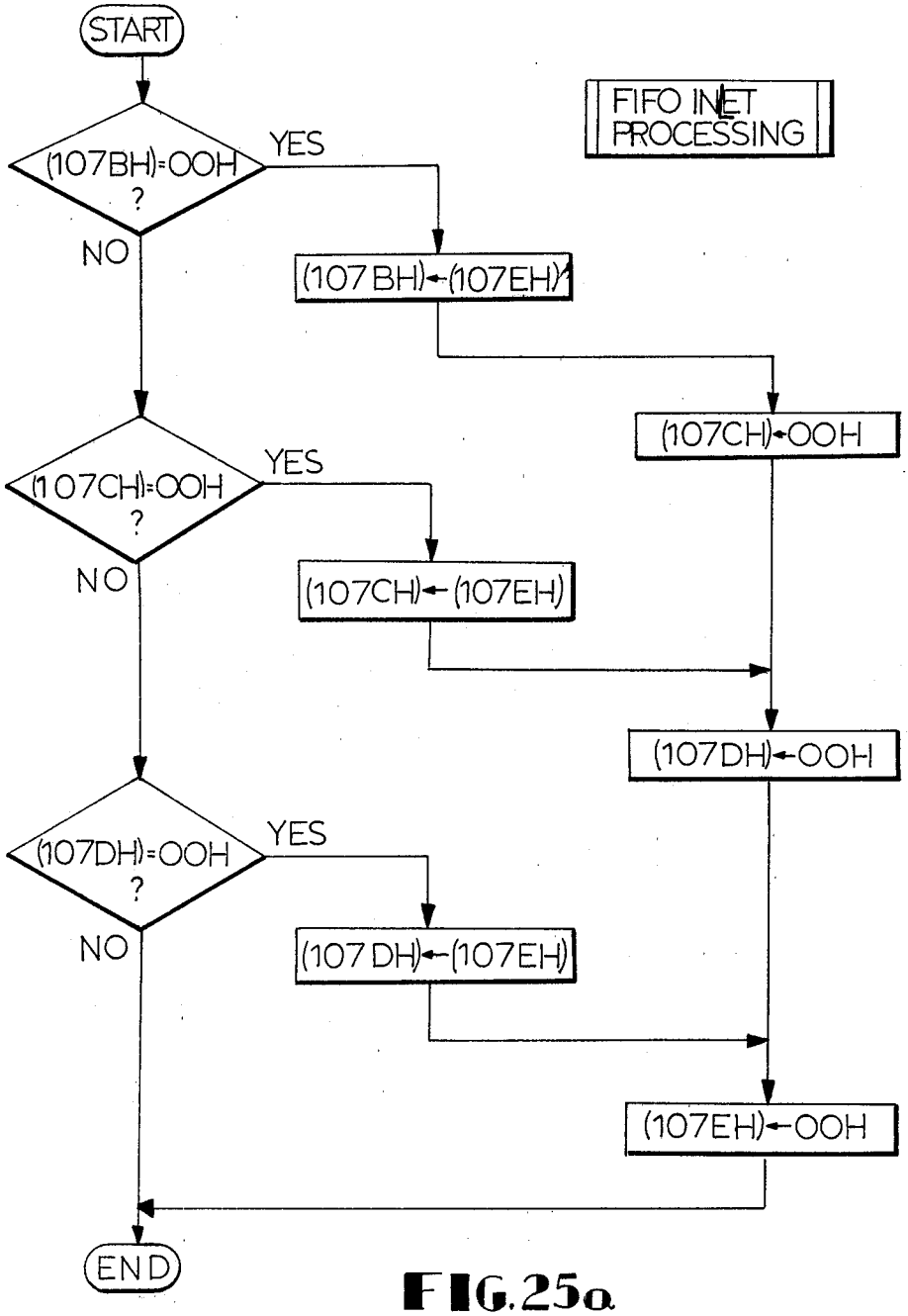
FIG. 25*a* is a diagram showing a detailed flow chart of "FIFO inlet processing"
Figure 25B:
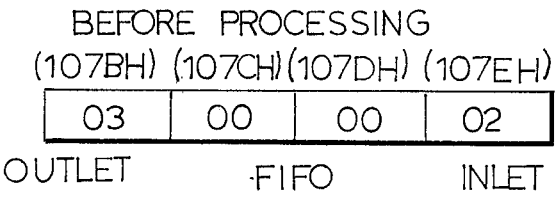
FIG. 25*b* and FIG. 25*c* are diagrams showing examples of the same.
Figure 25C:
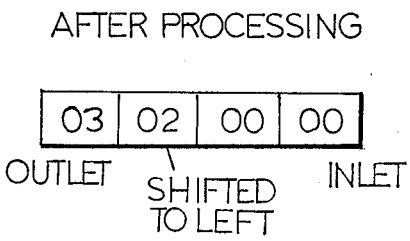
Figure 26A:
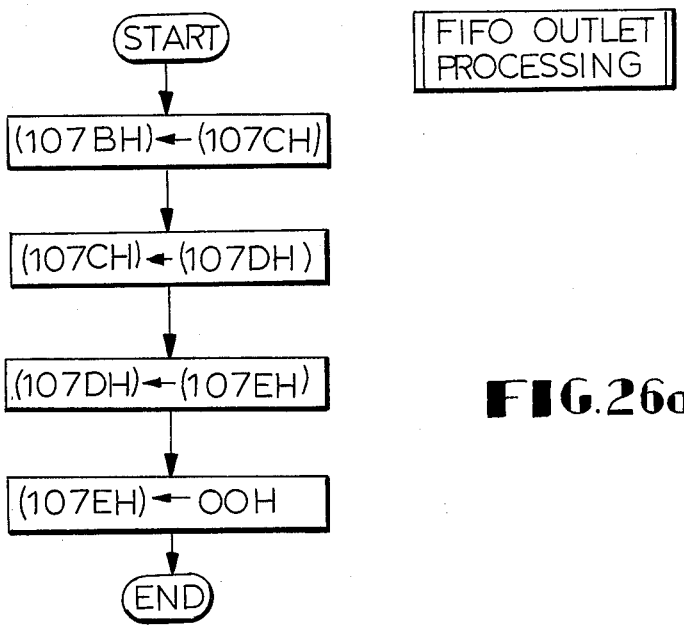
FIG. 26*a* shows a detailed flow chart of "FIFO outlet processing"
Figure 26B:
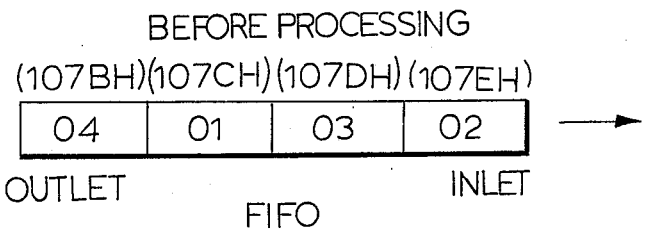
FIGS. 26*b* and 26*c* show examples of the same.
Figure 26C:
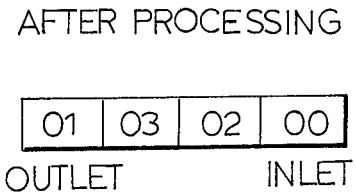

"Off processing" is processing which detects the released keys and releases the assigned channels. Its detailed flow chart is shown in FIGS. 23*a* and 23*b*. "On processing" is processing which detects newly depressed keys and assigns empty channels. Its detailed flow chart is shown in FIG. 24. FIG. 25*a* shows a detailed flow chart of the "FIFO inlet processing" in FIG. 21*a*, FIG. 21*b*, FIG. 23*a*, and FIG. 23*b* while FIGS. 25*b* and 25*c* show examples of the same. FIG. 26*a* shows a detailed flow chart of "FIFO outlet processing" in the "on processing" of FIG. 24 while FIGS. 26*b* and 26*c* show examples of the same.

From the memory areas of FIGS. 11 to 18 above and the operational flow charts shown in FIGS. 19 to 26*a*, it can be easily understood that the manual play channel assigner 6 shown in FIG. 3 performs the above manual play processing operation.

Finally, an explanation is given of an application example of channels.

Figure 4A:
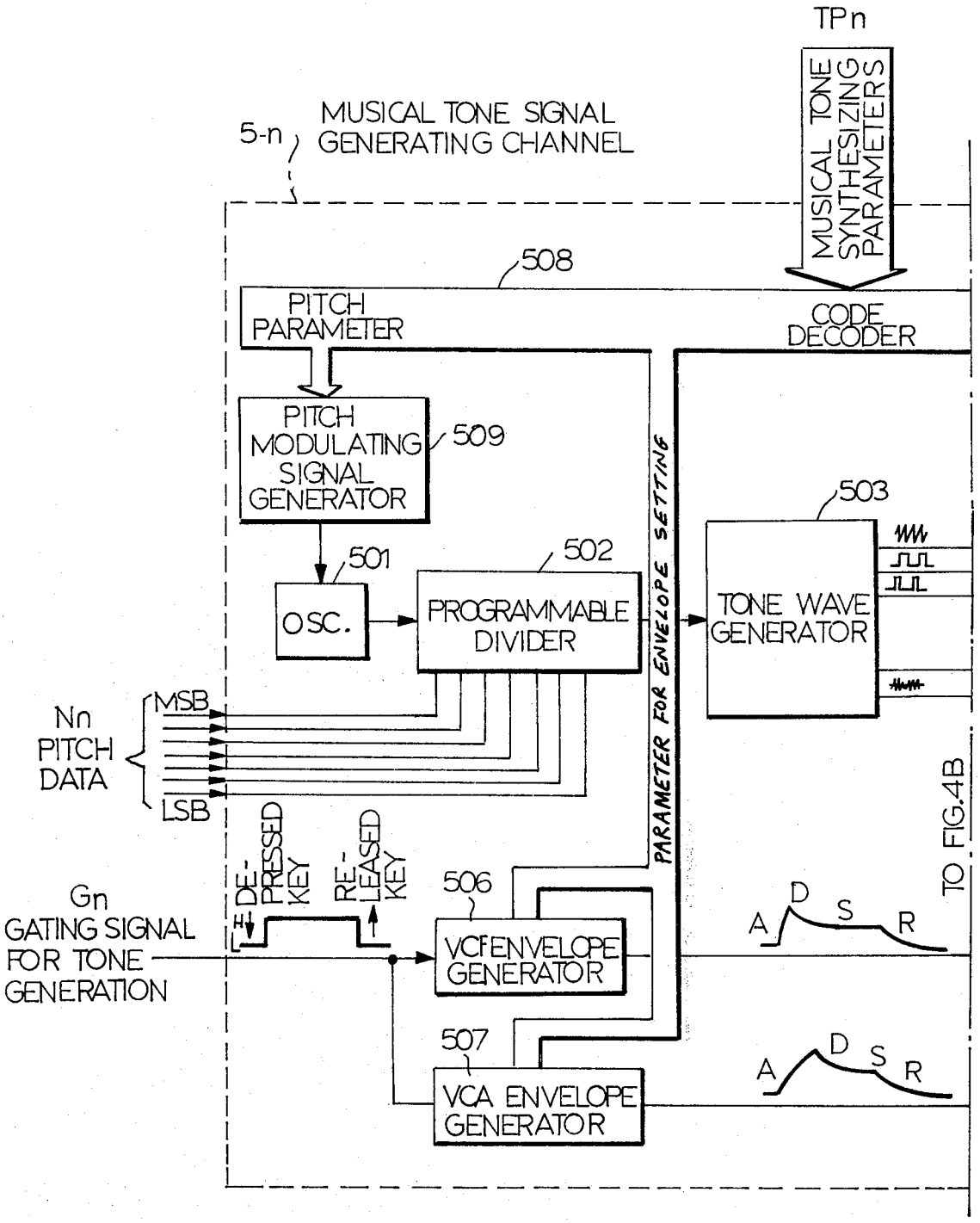
FIGS. 4*a* and 4*b* illustrate a circuit diagram of an actual application example of a musical tone signal generating channel 5–n.
Figure 4B:
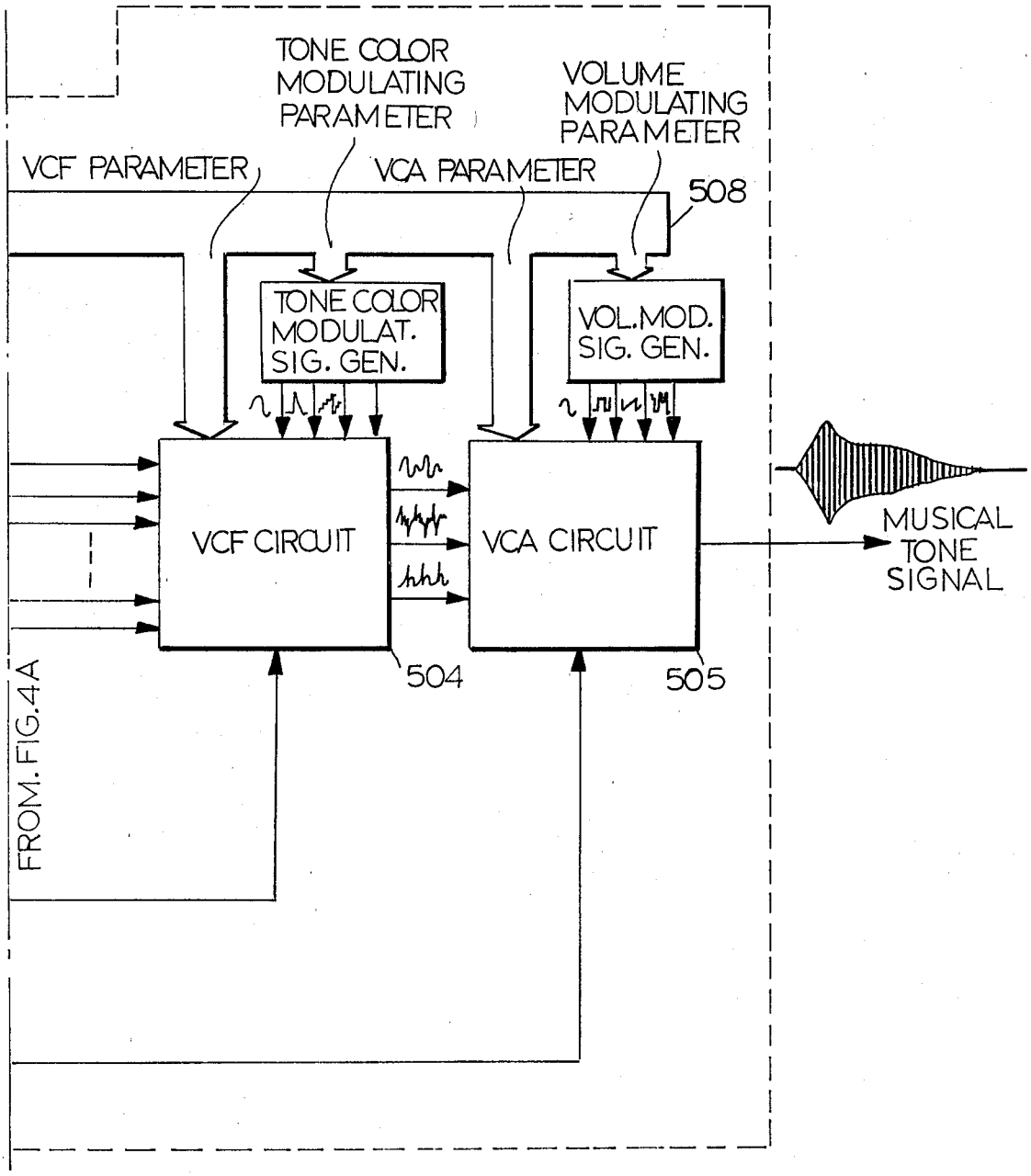

FIGS. 4*a* and 4*b* show a concrete application example of the musical tone signal generating channels 5–n (n=1 to 4).

Element 502 is a programmable divider which divides the output signals of oscillator 501 at a frequency division ratio corresponding to pitch data Nn and outputs a signal of a frequency corresponding to pitch data Nn. Element 503 is a tone wave generator which converts the output signals of programmable divider 502 into various tone waves and outputs them. Element 504 is a voltage controlled filter (VCF) circuit containing one or more VCFs and varies the spectra of the musical tone signals.

Element 505 is a voltage controlled amplifier (VCA) circuit containing one or more VCAs and varies the amplitude of the musical tone signals. Element 506 is a VCF envelope generator which takes the gating signals of tone generation Gn as triggering input and supplies envelope voltage to the control input of the VCF circuit 504. Element 507 is a VCA envelope generator which takes the gating signals of tone generation Gn as triggering input and supplies envelope voltage to the control input of the VCA circuit 505. Element 509 is a pitch modulating signal generator which generates pitch modulating signals modulating the oscillation frequency of oscillator 501. Element 501 is a tone color modulating signal generator which supplies the tone color modulating signals to the VCF circuit 504. Element 511 is a volume modulating signal generator which supplies volume modulating signals to the VCA circuit 505. Element 508 is a code converter which inputs and converts into code the musical tone synthesizing parameters TPn and supplies the pitch parameters to the pitch modulating signal generator 509, the parameters for envelope setting to the VCF envelope generator 506 and VCA envelope generator 507, the VCF parameters to the VCF circuit 504, the tone color modulating parameters to the tone color modulating signal generator 510, the VCA parameters to VCA circuit 505, and the volume modulating parameters to the volume modulating signal generator 511.

The application example of the musical tone signal generating channels 5–n shown in FIGS. 4*a* and 4*b* can be easily realized by publically known music synthesizer technologies and its composition is also already well known. A detailed description is therefore omitted.

As stated above, this invention allows the realization of an electronic musical instrument with extremely high value effects, through the rational use of a limited number of individual tone generation channels. For example, minus N performances together with automatic play becomes possible, when practicing performances extremely high effect step-by-step exercises becomes possible, and, even when not practicing, performances requiring very advanced techniques, such as ensembles with automatic performances not possible manually, become possible.

Now, in the application example of FIGS. 1*a* and 1*b*, the automatic play channel assigner 7 outputs the automatic play assignment channel data Da and the channel use data generator 8 outputs the channel use data DCH taking the And of the output data Da and the assignation date De of the channel-use assigning device 3. However, this invention can be realized even when the automatic play channel assigner 7 does not output the automatic play assignment channel data Da. Of course, channel changeover would then become slightly troublesome. For example, if only the three channels CH1 to CH3 were channels for priority automatic play and CH4 were set for sole manual play use, then when automatic play of music using CH1 and CH2 were performed, the channel use assigning device 3 would have to be operated in order to use the empty CH3 for manual play. In contrast to this, switchover of CH3 is performed automatically in the application example of FIGS 1*a* and 1*b*.

Furthermore, in the application example of FIGS. 1*a* and 1*b*, the manual play channel assigner 6, the automatic play channel assigner 7, the tone color assigner 11, and the data supplier 9 are separate. However, from the above explanation, it is conceivable and technically possible that these four functions be filled by a single microcomputer CPU.

In the explanation of the application example of FIGS. 1*a* and 1*b*, the number of channels 5 used was four. However, there is no limit on the number of channels and the invention can be realized in the same way with eight, sixteen, or even more channels.

What is claimed is:

1. An electronic musical instrument having a plurality of musical tone signal generating channels for generating tones and comprising:

an automatic play means having a memory for controlling the tone generation of said plurality of musical tone signal generating channels on the basis of automatic play data recorded in said memory so as to successively and automatically generate musical tones;

a manual play means having a keyboard and other manual performance controls for controlling the tone generation of said plurality of musical tone signal generating channels in response to said keyboard and other manual performance controls so as to generate musical tones;

wherein the tone generation by said plurality of musical tone signal generating channels is jointly controlled by said automatic play means and manual play means;

further having means wherein each of said musical tone signal generating channels are arranged so as to be controlled by either said automatic play means or by said manual play means so as to enable tone generation;

and further comprising a channel-use assigning means for assigning at least part of said musical tone signal generating channels previously specifically assigned for control by said automatic play means, so as to change them over to control by said manual play means;

and further comprising a channel assigner means which, along with having means for controlling the tone generation, based on said automatic play data, of the musical tone signal generating channels assigned for automatic play use by said automatic play means and controlled by said channel-use assigning means, also has means which enable the control of tone generation, based on play data generated by said manual play means, of the musical tone signal generating channels assigned for manual play use and controlled by said channel-use assigning means;

wherein said channel assigner means comprises:

(a) an automatic play channel assigner means for reading and decoding said automatic play data recorded in said memory and for outputting pitch data and tone generation control signals corresponding to said musical tone signal generating channels assigned for automatic play use and for outputting said automatic play assigning channel data which indicates which of the musical tone signal generating channels are assigned for automatic play use;

(b) a channel-use data generator which, based on assignment data from said channel-use assigning means and said automatic play assigning channel data, outputs channel-use data indicating which of said plurality of musical tone signal generating channels can be used for automatic play;

(c) a manual play channel assigner means which, based on said play data of said manual play means, outputs tone generation control signals and pitch data which is assigned to said plurality of tone signal generating channels other than those tone signal generating channels indicated as being for automatic play by said channel-use data; and (d) a data supplier means which receives said pitch data and tone generation control signals outputted from said automatic play channel assigner means and said pitch data and tone generation control signals outputted from said manual play channel assigner means, and then, in accordance with said channel-use data, matches said pitch data and tone generation control signals outputted in accordance with said plurality of musical tone signal generating channels used for automatic play from said automatic play channel assigner means and supplies them to respective musical tone signal generating channels and matches said pitch data and tone generation control signals outputted in accordance with said plurality of musical tone signal generating channels used for manual play from said manual play channel assigner means and supplies them to respective musical tone signal generating channels;

and wherein said automatic play channel assigner means comprises:

(a) an automatic play CPU means, including a data bus and automatic play data memory, for executing programmed commands for automatic play processing and for storing automatic play data and automatic play assignment channel data and pitch data and for generating tone generation control signals;

(b) an automatic play data readout means which is connected to said data bus of said automatic play CPU means and reads automatic play data from said automatic play data memory of said CPU means;

(c) a latching means for storing automatic play assignment channel data which is connected to said data bus and latches automatic assignment channel data from said data bus; and (d) an additional latching means for storing automatic play assignment data which is connected to said data bus and latches pitch data and tone generation control signals for automatic play from said data bus and assigned to said plurality of musical tone signal generating channels.

2. An electronic musical instrument having a plurality of musical tone signal generating channels for generating tones and comprising:

an automatic play means having a memory for controlling the tone generation of said plurality of musical tone signal generating channels on the basis of automatic play data recorded in said memory so as to successively and automatically generate musical tones;

a manual play means having a keyboard and other manual performance controls for controlling the tone generation of said plurality of musical tone signal generating channels in response to said keyboard and other manual performance controls so as to generate musical tones;

wherein the tone generation by said plurality of musical tone signal generating channels is jointly controlled by said automatic play means and manual play means;

further having means wherein each of said musical tone signal generating channels are arranged so as to be controlled by either said automatic play means or by said manual play means so as to enable tone generation;

and further comprising a channel-use assignment means for assigning at least part of said musical tone signal generating channels previously specifically assigned for control by said automatic play means, so as to change them over to control by said manual play means;

and further comprising a channel assigner means which, along with having means for controlling the tone generation, based on said automatic play data, of the musical tone signal generating channels assigned for automatic play use by said automatic play means and controlled by said channel-use assigning means, also has means which enable the control of tone generation, based on play data generated by said manual play means, of the musical tone signal generating channels assigned for manual play use and controlled by said channel-use assigning means;

wherein said channel assigner means comprises:

(a) an automatic play channel assigner means for reading and decoding said automatic play data recorded in said memory so as to output pitch data and tone generation control signals matching the musical tone signal generating channels assigned for automatic play;

(b) a channel-use data generator which, based on assignment data from said channel-use assigning means, outputs channel-use data indicating which of said plurality of musical tone signal generating channels can be used for automatic play;

(c) a manual play channel assigner means which, based on play data from said manual play means, outputs tone generation control signals and pitch data which is assigned to said plurality of tone signal generating channels other than those tone signal generating channels indicated as being for automatic play by said channel-use data; and (d) a data supplier which receives said pitch data and tone generation control signals outputted from said automatic play channel assigner means and said pitch data and tone generation control signals outputted from said manual play channel assigner means, and then, in accordance with said channel-use data, matches said pitch data and tone generation control signals outputted in accordance with the said plurality of tone signal generating channels used for automatic play from said automatic play channel assigner means and supplies them to respective musical tone signal generating channels and matches said pitch data and tone generation control signals outputted in accordance with said plurality of tone signal generating channels used for manual play from said manual play channel assigner means and supplies them to respective musical tone signal generating channels;

and wherein said automatic play channel assigner means comprises:

(a) an automatic play CPU means including a data bus and automatic play data memory, for executing programmed commands for automatic play processing and for storing automatic play data and automatic play assignment channel data and pitch data and for generating tone generation control signals;

(b) an automatic play data readout means which is connected to said data bus of said automatic play CPU means and reads automatic play data from said memory of said CPU means; and (c) a latching means for automatic play assignment data which is connected to said data bus and latches pitch data and tone generation control signals for automatic play which are assigned to said plurality of tone signal generating channels.

3. An electronic musical instrument having a plurality of musical tone signal generating channels for generating tones and comprising:

an automatic play means having a memory for controlling the tone generation of said plurality of musical tone signal generating channels on the basis of automatic play data recorded in said memory so as to successively and automatically generate musical tones;

a manual play means having a keyboard and other manual performance controls for controlling the tone generation of said plurality of musical tone signal generating channels in response to said keyboard and other manual performance controls so as to generate musical tones;

wherein the tone generation by said plurality of musical tone signal generating channels is jointly controlled by said automatic play means and manual play means;

further having means wherein each of said musical tone signal generating channels are arranged so as to be controlled by either said automatic play means or by said manual play means so as to enable tone generation;

and further comprising a channel-use assigning means for assigning at least part of said musical tone signal generating channels previously specifically assigned for control by said automatic play means, so as to change them over to control by said manual play means;

and further comprising a channel assigner means which, along with having means for controlling the tone generation, based on said automatic play data, of the musical tone signal generating channels assigned for automatic play use by said automatic play means and controlled by said channel-use assigning means, also has means which enable the control of tone generation, based on play data generated by said manual play means, of the musical tone signal generating channels assigned for manual play use and controlled by said channel-use assigning means;

wherein said channel assigner means comprises:

(a) an automatic play channel assigner means for reading and decoding said automatic play data recorded in said memory and for outputting pitch data and tone generation control signals corresponding to said musical tone signal generating channels assigned for automatic play use and for outputting said automatic play assigning channel data which indicates which of the musical tone signal generating channels are assigned for automatic play use;

(b) a channel-use data generator which, based on assignment data from said channel-use assigning means and said automatic play assigning channel data, outputs channel-use data indicating which of said plurality of musical tone signal generating channels can be used for automatic play;

(c) a manual play channel assigner means which, based on said play data of said manual play means, outputs tone generation control signals and pitch data which is assigned to said plurality of tone signal generating channels other than those tone signal generating channels indicated as being for automatic play by said channel-use data; and (d) a data supplier means which receives said pitch data and tone generation control signals outputted from said automatic play channel assigner means and said pitch data and tone generation control signals outputted from said manual play channel assigner means, and then, in accordance with said channel-use data, matches said pitch data and tone generation control signals outputted in accordance with said plurality of musical tone signal generating channels used for automatic play from said automatic play channel assigner means and supplies them to respective musical tone signal generating channels and matches said pitch data and tone generation control signals outputted in accordance with said plurality of musical tone signal generating channels used for manual play from said manual play channel assigner means and supplies them to respective musical tone signal generating channels;

and wherein said manual play channel assigner means comprises:

(a) a manual play CPU means including a data bus for executed programmed commands for manual play processing and for outputting channel use data and pitch data and tone generation control signals and play data, (b) an channel-use data readout means which is connected to said data bus of said manual play CPU means and reads channel-use data, (c) a manual play data readout means which is connected to said data bus so as to read play data of said manual play CPU means, and (d) a latching means for manual play assignment data which is connected to said data bus and latches pitch data and tone generation control signals for manual play which are assigned to said plurality of tone signal generating channels.

4. An electronic musical instrument according to claims 1 or 2 or 3, wherein said channel-use assigning means includes means to subsequently cancel the previous assignment changeover of a channel from control by said manual play means.

* * * * *